US010311780B2

(12) United States Patent
Chaji

(10) Patent No.: US 10,311,780 B2
(45) Date of Patent: Jun. 4, 2019

(54) SYSTEMS AND METHODS OF OPTICAL FEEDBACK

(71) Applicant: Ignis Innovation Inc., Waterloo (CA)

(72) Inventor: Gholamreza Chaji, Waterloo (CA)

(73) Assignee: Ignis Innovation Inc., Waterloo, Ontario ( * ) Notice: Subject to any disclaimer, the term of this patent is extended or adjusted under 35 U.S.C. 154(b) by 215 days.

(21) Appl. No.: 15/146,010

(22) Filed: May 4, 2016

(65) Prior Publication Data

US 2016/0329016 A1 Nov. 10, 2016

(30) Foreign Application Priority Data

May 4, 2015 (CA) ..... 2889870

(51) Int. Cl.
*G09G 3/3233* (2016.01)
*G09G 3/3258* (2016.01)
*G09G 3/3225* (2016.01)

(52) U.S. Cl.
CPC ..... *G09G 3/3225* (2013.01); *G09G 2360/147* (2013.01)

(58) Field of Classification Search
CPC ... G09G 2300/0819; G09G 2320/0242; G09G 2320/043; G09G 2320/045; G09G 2320/0295; G09G 2320/029; G09G 2330/10; G09G 2320/0613
See application file for complete search history.

(56) References Cited

U.S. PATENT DOCUMENTS

| | | | |
|---|---|---|---|
| 3,506,851 | A | 4/1970 | Polkinghorn |
| 3,774,055 | A | 11/1973 | Bapat |
| 4,090,096 | A | 5/1978 | Nagami |
| 4,160,934 | A | 7/1979 | Kirsch |
| 4,295,091 | A | 10/1981 | Ponkala |
| 4,354,162 | A | 10/1982 | Wright |
| 4,943,956 | A | 7/1990 | Noro |
| 4,996,523 | A | 2/1991 | Bell |

(Continued)

FOREIGN PATENT DOCUMENTS

| | | |
|---|---|---|
| CA | 1 294 034 | 1/1992 |
| CA | 2 109 951 | 11/1992 |

(Continued)

OTHER PUBLICATIONS

Ahnood : "Effect of threshold voltage instability on field effect mobility in thin film transistors deduced from constant current measurements"; dated Aug. 2009.

(Continued)

*Primary Examiner* — Lixi C Simpson
(74) *Attorney, Agent, or Firm* — Stratford Managers Corporation

(57) ABSTRACT

What is disclosed are systems and methods of optical feedback for pixel identification, evaluation, and calibration for active matrix light emitting diode device (AMOLED) and other emissive displays. Optical feedback is utilized to calibrate pixel whose output luminance exceeds a threshold difference from a reference value, and may include the use of sparse pixel activation to ensure pixel identification and luminance measurement, as well as a coarse calibration procedure for programming the starting calibration data for a fine calibration stage.

20 Claims, 8 Drawing Sheets

(56) References Cited

U.S. PATENT DOCUMENTS 5,153,420 A 10/1992 Hack
5,198,803 A 3/1993 Shie
5,204,661 A 4/1993 Hack
5,266,515 A 11/1993 Robb
5,489,918 A 2/1996 Mosier
5,498,880 A 3/1996 Lee
5,557,342 A 9/1996 Eto
5,561,381 A 10/1996 Jenkins et al.
5,572,444 A 11/1996 Lentz
5,589,847 A 12/1996 Lewis
5,619,033 A 4/1997 Weisfield
5,648,276 A 7/1997 Hara
5,670,973 A 9/1997 Bassetti
5,684,365 A 11/1997 Tang
5,691,783 A 11/1997 Numao
5,714,968 A 2/1998 Ikeda
5,723,950 A 3/1998 Wei
5,744,824 A 4/1998 Kousai
5,745,660 A 4/1998 Kolpatzik
5,748,160 A 5/1998 Shieh
5,815,303 A 9/1998 Berlin
5,870,071 A 2/1999 Kawahata
5,874,803 A 2/1999 Garbuzov
5,880,582 A 3/1999 Sawada
5,903,248 A 5/1999 Irwin
5,917,280 A 6/1999 Burrows
5,923,794 A 7/1999 McGrath
5,945,972 A 8/1999 Okumura
5,949,398 A 9/1999 Kim
5,952,789 A 9/1999 Stewart
5,952,991 A 9/1999 Akiyama
5,982,104 A 11/1999 Sasaki
5,990,629 A 11/1999 Yamada
6,023,259 A 2/2000 Howard
6,069,365 A 5/2000 Chow
6,091,203 A 7/2000 Kawashima
6,097,360 A 8/2000 Holloman
6,144,222 A 11/2000 Ho
6,177,915 B1 1/2001 Beeteson
6,229,506 B1 5/2001 Dawson
6,229,508 B1 5/2001 Kane
6,246,180 B1 6/2001 Nishigaki
6,252,248 B1 6/2001 Sano
6,259,424 B1 7/2001 Kurogane
6,262,589 B1 7/2001 Tamukai
6,271,825 B1 8/2001 Greene
6,288,696 B1 9/2001 Holloman
6,304,039 B1 10/2001 Appelberg
6,307,322 B1 10/2001 Dawson
6,310,962 B1 10/2001 Chung
6,320,325 B1 11/2001 Cok
6,323,631 B1 11/2001 Juang
6,329,971 B2 12/2001 McKnight
6,356,029 B1 3/2002 Hunter
6,373,454 B1 4/2002 Knapp
6,377,237 B1 4/2002 Sojourner
6,392,617 B1 5/2002 Gleason
6,404,139 B1 6/2002 Sasaki et al.
6,414,661 B1 7/2002 Shen
6,417,825 B1 7/2002 Stewart
6,433,488 B1 8/2002 Bu
6,437,106 B1 8/2002 Stoner
6,445,369 B1 9/2002 Yang
6,475,845 B2 11/2002 Kimura
6,501,098 B2 12/2002 Yamazaki
6,501,466 B1 12/2002 Yamagishi
6,518,962 B2 2/2003 Kimura
6,522,315 B2 2/2003 Ozawa
6,525,683 B1 2/2003 Gu
6,531,827 B2 3/2003 Kawashima
6,541,921 B1 4/2003 Luciano, Jr. et al.
6,542,138 B1 4/2003 Shannon
6,555,420 B1 4/2003 Yamazaki
6,577,302 B2 6/2003 Hunter
6,580,408 B1 6/2003 Bae
6,580,657 B2 6/2003 Sanford
6,583,398 B2 6/2003 Harkin
6,583,775 B1 6/2003 Sekiya
6,594,606 B2 7/2003 Everitt
6,618,030 B2 9/2003 Kane
6,639,244 B1 10/2003 Yamazaki
6,668,645 B1 12/2003 Gilmour
6,677,713 B1 1/2004 Sung
6,680,580 B1 1/2004 Sung
6,687,266 B1 2/2004 Ma
6,690,000 B1 2/2004 Muramatsu
6,690,344 B1 2/2004 Takeuchi
6,693,388 B2 2/2004 Oomura
6,693,610 B2 2/2004 Shannon
6,697,057 B2 2/2004 Koyama
6,720,942 B2 4/2004 Lee
6,724,151 B2 4/2004 Yoo
6,734,636 B2 5/2004 Sanford
6,738,034 B2 5/2004 Kaneko
6,738,035 B1 5/2004 Fan
6,753,655 B2 6/2004 Shih
6,753,834 B2 6/2004 Mikami
6,756,741 B2 6/2004 Li
6,756,952 B1 6/2004 Decaux
6,756,958 B2 6/2004 Furuhashi
6,765,549 B1 7/2004 Yamazaki et al.
6,771,028 B1 8/2004 Winters
6,777,712 B2 8/2004 Sanford
6,777,888 B2 8/2004 Kondo
6,781,567 B2 8/2004 Kimura
6,806,497 B2 10/2004 Jo
6,806,638 B2 10/2004 Lih et al.
6,806,857 B2 10/2004 Sempel
6,809,706 B2 10/2004 Shimoda
6,815,975 B2 11/2004 Nara
6,828,950 B2 12/2004 Koyama
6,853,371 B2 2/2005 Miyajima
6,859,193 B1 2/2005 Yumoto
6,873,117 B2 3/2005 Ishizuka
6,876,346 B2 4/2005 Anzai
6,885,356 B2 4/2005 Hashimoto
6,900,485 B2 5/2005 Lee
6,903,734 B2 6/2005 Eu
6,909,243 B2 6/2005 Inukai
6,909,419 B2 6/2005 Zavracky
6,911,960 B1 6/2005 Yokoyama
6,911,964 B2 6/2005 Lee
6,914,448 B2 7/2005 Jinno
6,919,871 B2 7/2005 Kwon
6,924,602 B2 8/2005 Komiya
6,937,215 B2 8/2005 Lo
6,937,220 B2 8/2005 Kitaura
6,940,214 B1 9/2005 Komiya
6,943,500 B2 9/2005 LeChevalier
6,947,022 B2 9/2005 McCartney
6,954,194 B2 10/2005 Matsumoto
6,956,547 B2 10/2005 Bae
6,975,142 B2 12/2005 Azami
6,975,332 B2 12/2005 Arnold
6,995,510 B2 2/2006 Murakami
6,995,519 B2 2/2006 Arnold
7,023,408 B2 4/2006 Chen
7,027,015 B2 4/2006 Booth, Jr.
7,027,078 B2 4/2006 Reihl
7,034,793 B2 4/2006 Sekiya
7,038,392 B2 5/2006 Libsch
7,053,875 B2 5/2006 Chou
7,057,359 B2 6/2006 Hung
7,061,451 B2 6/2006 Kimura
7,064,733 B2 6/2006 Cok
7,071,932 B2 7/2006 Libsch
7,088,051 B1 8/2006 Cok
7,088,052 B2 8/2006 Kimura
7,102,378 B2 9/2006 Kuo
7,106,285 B2 9/2006 Naugler
7,112,820 B2 9/2006 Chang
7,116,058 B2 10/2006 Lo
7,119,493 B2 10/2006 Fryer
7,122,835 B1 10/2006 Ikeda

(56) References Cited

U.S. PATENT DOCUMENTS 7,127,380 B1 10/2006 Iverson
7,129,914 B2 10/2006 Knapp
7,161,566 B2 1/2007 Cok
7,164,417 B2 1/2007 Cok
7,193,589 B2 3/2007 Yoshida
7,224,332 B2 5/2007 Cok
7,227,519 B1 6/2007 Kawase
7,245,277 B2 7/2007 Ishizuka
7,246,912 B2 7/2007 Burger et al.
7,248,236 B2 7/2007 Nathan
7,262,753 B2 8/2007 Tanghe
7,274,363 B2 9/2007 Ishizuka
7,310,092 B2 12/2007 Imamura
7,315,295 B2 1/2008 Kimura
7,321,348 B2 1/2008 Cok
7,339,560 B2 3/2008 Sun
7,355,574 B1 4/2008 Leon
7,358,941 B2 4/2008 Ono
7,368,868 B2 5/2008 Sakamoto
7,397,485 B2 7/2008 Miller
7,411,571 B2 8/2008 Huh
7,414,600 B2 8/2008 Nathan
7,423,617 B2 9/2008 Giraldo
7,453,054 B2 11/2008 Lee
7,474,285 B2 1/2009 Kimura
7,502,000 B2 3/2009 Yuki
7,528,812 B2 5/2009 Tsuge
7,535,449 B2 5/2009 Miyazawa
7,554,512 B2 6/2009 Steer
7,569,849 B2 8/2009 Nathan
7,576,718 B2 8/2009 Miyazawa
7,580,012 B2 8/2009 Kim
7,589,707 B2 9/2009 Chou
7,605,792 B2 10/2009 Son
7,609,239 B2 10/2009 Chang
7,619,594 B2 11/2009 Hu
7,619,597 B2 11/2009 Nathan
7,633,470 B2 12/2009 Kane
7,656,370 B2 2/2010 Schneider
7,675,485 B2 3/2010 Steer
7,800,558 B2 9/2010 Routley
7,847,764 B2 12/2010 Cok
7,859,492 B2 12/2010 Kohno
7,868,859 B2 1/2011 Tomida
7,876,294 B2 1/2011 Sasaki
7,924,249 B2 4/2011 Nathan
7,932,883 B2 4/2011 Klompenhouwer
7,969,390 B2 6/2011 Yoshida
7,978,187 B2 7/2011 Nathan
7,994,712 B2 8/2011 Sung
8,026,876 B2 9/2011 Nathan
8,031,180 B2 10/2011 Miyamoto et al.
8,049,420 B2 11/2011 Tamura
8,077,123 B2 12/2011 Naugler, Jr.
8,115,707 B2 2/2012 Nathan
8,208,084 B2 6/2012 Lin
8,223,177 B2 7/2012 Nathan
8,232,939 B2 7/2012 Nathan
8,259,044 B2 9/2012 Nathan
8,264,431 B2 9/2012 Bulovic
8,279,143 B2 10/2012 Nathan
8,294,696 B2 10/2012 Min et al.
8,314,783 B2 11/2012 Sambandan et al.
8,339,386 B2 12/2012 Leon
8,441,206 B2 5/2013 Myers
8,493,296 B2 7/2013 Ogawa
8,581,809 B2 11/2013 Nathan et al.
8,922,544 B2 12/2014 Chaji et al.
9,125,278 B2 9/2015 Nathan et al.
9,368,063 B2 6/2016 Chaji et al.
9,536,460 B2 1/2017 Chaji et al.
2001/0002703 A1 6/2001 Koyama
2001/0009283 A1 7/2001 Arao
2001/0024181 A1 9/2001 Kubota
2001/0024186 A1 9/2001 Kane
2001/0026257 A1 10/2001 Kimura
2001/0030323 A1 10/2001 Ikeda
2001/0035863 A1 11/2001 Kimura
2001/0038367 A1 11/2001 Inukai
2001/0040541 A1 11/2001 Yoneda
2001/0043173 A1 11/2001 Troutman
2001/0045929 A1 11/2001 Prache
2001/0052606 A1 12/2001 Sempel
2001/0052940 A1 12/2001 Hagihara
2002/0000576 A1 1/2002 Inukai
2002/0011796 A1 1/2002 Koyama
2002/0011799 A1 1/2002 Kimura
2002/0012057 A1 1/2002 Kimura
2002/0014851 A1 2/2002 Tai
2002/0018034 A1 2/2002 Ohki
2002/0030190 A1 3/2002 Ohtani
2002/0047565 A1 4/2002 Nara
2002/0052086 A1 5/2002 Maeda
2002/0067134 A1 6/2002 Kawashima
2002/0084463 A1 7/2002 Sanford
2002/0101152 A1 8/2002 Kimura
2002/0101172 A1 8/2002 Bu
2002/0105279 A1 8/2002 Kimura
2002/0117722 A1 8/2002 Osada
2002/0122308 A1 9/2002 Ikeda
2002/0158587 A1 10/2002 Komiya
2002/0158666 A1 10/2002 Azami
2002/0158823 A1 10/2002 Zavracky
2002/0167471 A1 11/2002 Everitt
2002/0167474 A1 11/2002 Everitt
2002/0169575 A1 11/2002 Everitt
2002/0180369 A1 12/2002 Koyama
2002/0180721 A1 12/2002 Kimura
2002/0181276 A1 12/2002 Yamazaki
2002/0183945 A1 12/2002 Everitt
2002/0186214 A1 12/2002 Siwinski
2002/0190924 A1 12/2002 Asano
2002/0190971 A1 12/2002 Nakamura
2002/0195967 A1 12/2002 Kim
2002/0195968 A1 12/2002 Sanford
2003/0020413 A1 1/2003 Oomura
2003/0030603 A1 2/2003 Shimoda
2003/0043088 A1 3/2003 Booth
2003/0057895 A1 3/2003 Kimura
2003/0058226 A1 3/2003 Bertram
2003/0062524 A1 4/2003 Kimura
2003/0063081 A1 4/2003 Kimura
2003/0071821 A1 4/2003 Sundahl
2003/0076048 A1 4/2003 Rutherford
2003/0090447 A1 5/2003 Kimura
2003/0090481 A1 5/2003 Kimura
2003/0107560 A1 6/2003 Yumoto
2003/0111966 A1 6/2003 Mikami
2003/0122745 A1 7/2003 Miyazawa
2003/0122749 A1 7/2003 Booth, Jr. et al.
2003/0122813 A1 7/2003 Ishizuki
2003/0142088 A1 7/2003 LeChevalier
2003/0146897 A1 8/2003 Hunter
2003/0151569 A1 8/2003 Lee
2003/0156101 A1 8/2003 Le Chevalier
2003/0169241 A1 9/2003 LeChevalier
2003/0174152 A1 9/2003 Noguchi
2003/0179626 A1 9/2003 Sanford
2003/0185438 A1 10/2003 Osawa
2003/0197663 A1 10/2003 Lee
2003/0210256 A1 11/2003 Mori
2003/0230141 A1 12/2003 Gilmour
2003/0230980 A1 12/2003 Forrest
2003/0231148 A1 12/2003 Lin
2004/0032382 A1 2/2004 Cok
2004/0041750 A1 3/2004 Abe
2004/0066357 A1 4/2004 Kawasaki
2004/0070557 A1 4/2004 Asano
2004/0070565 A1 4/2004 Nayar
2004/0090186 A1 5/2004 Kanauchi
2004/0090400 A1 5/2004 Yoo
2004/0095297 A1 5/2004 Libsch
2004/0100427 A1 5/2004 Miyazawa
2004/0108518 A1 6/2004 Jo

(56) References Cited

U.S. PATENT DOCUMENTS

2004/0135749 A1 7/2004 Kondakov
2004/0140982 A1 7/2004 Pate
2004/0145547 A1 7/2004 Oh
2004/0150592 A1 8/2004 Mizukoshi
2004/0150594 A1 8/2004 Koyama
2004/0150595 A1 8/2004 Kasai
2004/0155841 A1 8/2004 Kasai
2004/0174347 A1 9/2004 Sun
2004/0174349 A1 9/2004 Libsch
2004/0174354 A1 9/2004 Ono
2004/0178743 A1 9/2004 Miller
2004/0183759 A1 9/2004 Stevenson
2004/0196275 A1 10/2004 Hattori
2004/0207615 A1 10/2004 Yumoto
2004/0227697 A1 11/2004 Mori
2004/0233125 A1 11/2004 Tanghe
2004/0239596 A1 12/2004 Ono
2004/0246246 A1 12/2004 Tobita
2004/0252089 A1 12/2004 Ono
2004/0257313 A1 12/2004 Kawashima
2004/0257353 A1 12/2004 Imamura
2004/0257355 A1 12/2004 Naugler
2004/0263437 A1 12/2004 Hattori
2004/0263444 A1 12/2004 Kimura
2004/0263445 A1 12/2004 Inukai
2004/0263541 A1 12/2004 Takeuchi
2005/0007355 A1 1/2005 Miura
2005/0007357 A1 1/2005 Yamashita
2005/0007392 A1 1/2005 Kasai
2005/0017650 A1 1/2005 Fryer
2005/0024081 A1 2/2005 Kuo
2005/0024393 A1 2/2005 Kondo
2005/0030267 A1 2/2005 Tanghe
2005/0057484 A1 3/2005 Diefenbaugh
2005/0057580 A1 3/2005 Yamano
2005/0067970 A1 3/2005 Libsch
2005/0067971 A1 3/2005 Kane
2005/0068270 A1 3/2005 Awakura
2005/0068275 A1 3/2005 Kane
2005/0073264 A1 4/2005 Matsumoto
2005/0083323 A1 4/2005 Suzuki
2005/0088103 A1 4/2005 Kageyama
2005/0105031 A1 5/2005 Shih
2005/0110420 A1 5/2005 Arnold
2005/0110807 A1 5/2005 Chang
2005/0122294 A1 6/2005 Ben-David
2005/0140598 A1 6/2005 Kim
2005/0140610 A1 6/2005 Smith
2005/0145891 A1 7/2005 Abe
2005/0156831 A1 7/2005 Yamazaki
2005/0162079 A1 7/2005 Sakamoto
2005/0168416 A1 8/2005 Hashimoto
2005/0179626 A1 8/2005 Yuki
2005/0179628 A1 8/2005 Kimura
2005/0185200 A1 8/2005 Tobol
2005/0200575 A1 9/2005 Kim
2005/0204219 A1* 9/2005 Taguchi ..... G09G 3/006 714/724
2005/0206590 A1 9/2005 Sasaki
2005/0212787 A1 9/2005 Noguchi
2005/0219184 A1 10/2005 Zehner
2005/0225683 A1 10/2005 Nozawa
2005/0248515 A1 11/2005 Naugler
2005/0269959 A1 12/2005 Uchino
2005/0269960 A1 12/2005 Ono
2005/0280615 A1 12/2005 Cok
2005/0280766 A1 12/2005 Johnson
2005/0285822 A1 12/2005 Reddy
2005/0285825 A1 12/2005 Eom
2006/0001613 A1 1/2006 Routley
2006/0007072 A1 1/2006 Choi
2006/0007206 A1 1/2006 Reddy et al.
2006/0007249 A1 1/2006 Reddy
2006/0012310 A1 1/2006 Chen
2006/0012311 A1 1/2006 Ogawa
2006/0015272 A1 1/2006 Giraldo et al.
2006/0022305 A1 2/2006 Yamashita
2006/0022907 A1 2/2006 Uchino et al.
2006/0027807 A1 2/2006 Nathan
2006/0030084 A1 2/2006 Young
2006/0038501 A1 2/2006 Koyama et al.
2006/0038758 A1 2/2006 Routley
2006/0038762 A1 2/2006 Chou
2006/0044227 A1 3/2006 Hadcock
2006/0061248 A1 3/2006 Cok
2006/0066533 A1 3/2006 Sato
2006/0077134 A1 4/2006 Hector et al.
2006/0077135 A1 4/2006 Cok
2006/0077142 A1 4/2006 Kwon
2006/0082523 A1 4/2006 Guo
2006/0092185 A1 5/2006 Jo
2006/0097628 A1 5/2006 Suh
2006/0097631 A1 5/2006 Lee
2006/0103324 A1 5/2006 Kim et al.
2006/0103611 A1 5/2006 Choi
2006/0125740 A1 6/2006 Shirasaki et al.
2006/0149493 A1 7/2006 Sambandan
2006/0170623 A1 8/2006 Naugler, Jr.
2006/0176250 A1 8/2006 Nathan
2006/0208961 A1 9/2006 Nathan
2006/0208971 A1 9/2006 Deane
2006/0214888 A1 9/2006 Schneider
2006/0231740 A1 10/2006 Kasai
2006/0232522 A1 10/2006 Roy
2006/0244697 A1 11/2006 Lee
2006/0256048 A1 11/2006 Fish et al.
2006/0261841 A1 11/2006 Fish
2006/0273997 A1 12/2006 Nathan
2006/0279481 A1 12/2006 Haruna
2006/0284801 A1 12/2006 Yoon
2006/0284802 A1 12/2006 Kohno
2006/0284895 A1 12/2006 Marcu
2006/0290614 A1 12/2006 Nathan
2006/0290618 A1 12/2006 Goto
2007/0001937 A1 1/2007 Park
2007/0001939 A1 1/2007 Hashimoto
2007/0008251 A1 1/2007 Kohno
2007/0008268 A1 1/2007 Park
2007/0008297 A1 1/2007 Bassetti
2007/0057873 A1 3/2007 Uchino
2007/0057874 A1 3/2007 Le Roy
2007/0069998 A1 3/2007 Naugler
2007/0075727 A1 4/2007 Nakano
2007/0076226 A1 4/2007 Klompenhouwer
2007/0080905 A1 4/2007 Takahara
2007/0080906 A1 4/2007 Tanabe
2007/0080908 A1 4/2007 Nathan
2007/0097038 A1 5/2007 Yamazaki
2007/0097041 A1 5/2007 Park
2007/0103411 A1 5/2007 Cok et al.
2007/0103419 A1 5/2007 Uchino
2007/0115221 A1 5/2007 Buchhauser
2007/0115440 A1* 5/2007 Wiklof ..... G03B 21/14 353/69
2007/0126672 A1 6/2007 Tada et al.
2007/0164664 A1 7/2007 Ludwicki
2007/0164937 A1 7/2007 Jung et al.
2007/0164938 A1 7/2007 Shin
2007/0182671 A1 8/2007 Nathan
2007/0236134 A1 10/2007 Ho
2007/0236440 A1 10/2007 Wacyk
2007/0236517 A1 10/2007 Kimpe
2007/0241999 A1 10/2007 Lin
2007/0273294 A1 11/2007 Nagayama
2007/0285359 A1 12/2007 Ono
2007/0290957 A1 12/2007 Cok
2007/0290958 A1 12/2007 Cok
2007/0296672 A1 12/2007 Kim
2008/0001525 A1 1/2008 Chao
2008/0001544 A1 1/2008 Murakami
2008/0030518 A1 2/2008 Higgins
2008/0036706 A1 2/2008 Kitazawa
2008/0036708 A1 2/2008 Shirasaki
2008/0042942 A1 2/2008 Takahashi

(56) References Cited

U.S. PATENT DOCUMENTS

2008/0042948 A1 2/2008 Yamashita
2008/0048951 A1 2/2008 Naugler, Jr.
2008/0055209 A1 3/2008 Cok
2008/0055211 A1 3/2008 Ogawa
2008/0074413 A1 3/2008 Ogura
2008/0088549 A1 4/2008 Nathan
2008/0088648 A1 4/2008 Nathan
2008/0111766 A1 5/2008 Uchino
2008/0116787 A1 5/2008 Hsu
2008/0117144 A1 5/2008 Nakano et al.
2008/0136770 A1 6/2008 Peker et al.
2008/0150845 A1 6/2008 Ishii
2008/0150847 A1 6/2008 Kim
2008/0158115 A1 7/2008 Cordes
2008/0158648 A1 7/2008 Cummings
2008/0191976 A1 8/2008 Nathan
2008/0198103 A1 8/2008 Toyomura
2008/0211749 A1 9/2008 Weitbruch
2008/0218451 A1 9/2008 Miyamoto
2008/0231558 A1 9/2008 Naugler
2008/0231562 A1 9/2008 Kwon
2008/0231625 A1 9/2008 Minami
2008/0246713 A1 10/2008 Lee
2008/0252223 A1 10/2008 Toyoda
2008/0252571 A1 10/2008 Hente
2008/0259020 A1 10/2008 Fisekovic
2008/0290805 A1 11/2008 Yamada
2008/0297055 A1 12/2008 Miyake
2009/0033598 A1 2/2009 Suh
2009/0058772 A1 3/2009 Lee
2009/0109142 A1 4/2009 Takahara
2009/0121994 A1 5/2009 Miyata
2009/0146926 A1 6/2009 Sung
2009/0160743 A1 6/2009 Tomida
2009/0174628 A1 7/2009 Wang
2009/0184901 A1 7/2009 Kwon
2009/0195483 A1 8/2009 Naugler, Jr.
2009/0201281 A1 8/2009 Routley
2009/0206764 A1 8/2009 Schemmann
2009/0207160 A1 8/2009 Shirasaki et al.
2009/0213046 A1 8/2009 Nam
2009/0244046 A1 10/2009 Seto
2009/0262047 A1 10/2009 Yamashita
2010/0004891 A1 1/2010 Ahlers
2010/0026725 A1 2/2010 Smith
2010/0039422 A1 2/2010 Seto
2010/0039458 A1 2/2010 Nathan
2010/0045646 A1 2/2010 Kishi
2010/0045650 A1 2/2010 Fish et al.
2010/0060911 A1 3/2010 Marcu
2010/0073335 A1 3/2010 Min et al.
2010/0073357 A1 3/2010 Min et al.
2010/0079419 A1 4/2010 Shibusawa
2010/0085282 A1 4/2010 Yu
2010/0103160 A1 4/2010 Jeon
2010/0134469 A1 6/2010 Ogura et al.
2010/0134475 A1 6/2010 Ogura et al.
2010/0165002 A1 7/2010 Ahn
2010/0194670 A1 8/2010 Cok
2010/0207960 A1 8/2010 Kimpe
2010/0225630 A1 9/2010 Levey
2010/0251295 A1 9/2010 Amento
2010/0277400 A1 11/2010 Jeong
2010/0315319 A1 12/2010 Cok
2011/0050870 A1 3/2011 Hanari
2011/0063197 A1 3/2011 Chung
2011/0069051 A1 3/2011 Nakamura
2011/0069089 A1 3/2011 Kopf
2011/0069096 A1 3/2011 Li
2011/0074750 A1 3/2011 Leon
2011/0074762 A1 3/2011 Shirasaki et al.
2011/0149166 A1 6/2011 Botzas
2011/0169798 A1 7/2011 Lee
2011/0175895 A1 7/2011 Hayakawa
2011/0181630 A1 7/2011 Smith
2011/0199395 A1 8/2011 Nathan
2011/0227964 A1 9/2011 Chaji
2011/0234644 A1* 9/2011 Park ..... G09G 3/2003 345/690
2011/0242074 A1 10/2011 Bert et al.
2011/0273399 A1 11/2011 Lee
2011/0279488 A1 11/2011 Nathan et al.
2011/0292006 A1 12/2011 Kim
2011/0293480 A1 12/2011 Mueller
2012/0056558 A1 3/2012 Toshiya
2012/0062565 A1 3/2012 Fuchs
2012/0262184 A1 10/2012 Shen
2012/0299970 A1 11/2012 Bae
2012/0299973 A1 11/2012 Jaffari et al.
2012/0299978 A1 11/2012 Chaji
2013/0002527 A1 1/2013 Kim
2013/0027381 A1 1/2013 Nathan
2013/0057595 A1 3/2013 Nathan
2013/0112960 A1 5/2013 Chaji
2013/0135272 A1 5/2013 Park
2013/0162617 A1 6/2013 Yoon
2013/0201223 A1 8/2013 Li et al.
2013/0241813 A1 9/2013 Tanaka
2013/0309821 A1 11/2013 Yoo
2013/0321671 A1 12/2013 Cote
2014/0015824 A1 1/2014 Chaji et al.
2014/0022289 A1 1/2014 Lee
2014/0043316 A1 2/2014 Chaji et al.
2014/0055500 A1 2/2014 Lai
2014/0111567 A1 4/2014 Nathan et al.
2016/0006960 A1* 1/2016 Takahashi ..... H04N 5/367 348/246
2016/0275860 A1 9/2016 Wu

FOREIGN PATENT DOCUMENTS

CA 2 249 592 7/1998
CA 2 303 302 3/1999
CA 2 368 386 9/1999
CA 2 242 720 1/2000
CA 2 354 018 6/2000
CA 2 432 530 7/2002
CA 2 436 451 8/2002
CA 2 438 577 8/2002
CA 2 463 653 1/2004
CA 2 498 136 3/2004
CA 2 522 396 11/2004
CA 2 443 206 3/2005
CA 2 472 671 12/2005
CA 2 567 076 1/2006
CA 2526436 2/2006
CA 2 526 782 4/2006
CA 2 541 531 7/2006
CA 2 550 102 4/2008
CA 2 773 699 10/2013
CN 1381032 11/2002
CN 1448908 10/2003
CN 1623180 A 6/2005
CN 1682267 A 10/2005
CN 1758309 A 4/2006
CN 1760945 4/2006
CN 1886774 12/2006
CN 101194300 A 6/2008
CN 101449311 6/2009
CN 101615376 12/2009
CN 102656621 9/2012
CN 102725786 A 10/2012
EP 0 158 366 10/1985
EP 1 028 471 8/2000
EP 1 111 577 6/2001
EP 1 130 565 A1 9/2001
EP 1 194 013 4/2002
EP 1 335 430 A1 8/2003
EP 1 372 136 12/2003
EP 1 381 019 1/2004
EP 1 418 566 5/2004
EP 1 429 312 A 6/2004
EP 145 0341 A 8/2004
EP 1 465 143 A 10/2004

(56) References Cited

FOREIGN PATENT DOCUMENTS

| | | | |
|---|---|---|---|
| EP | 1 469 448 | A | 10/2004 |
| EP | 1 521 203 | A2 | 4/2005 |
| EP | 1 594 347 | | 11/2005 |
| EP | 1 784 055 | A2 | 5/2007 |
| EP | 1854338 | A1 | 11/2007 |
| EP | 1 879 169 | A1 | 1/2008 |
| EP | 1 879 172 | | 1/2008 |
| EP | 2395499 | A1 | 12/2011 |
| GB | 2 389 951 | | 12/2003 |
| JP | 1272298 | | 10/1989 |
| JP | 4-042619 | | 2/1992 |
| JP | 6-314977 | | 11/1994 |
| JP | 8-340243 | | 12/1996 |
| JP | 09-090405 | | 4/1997 |
| JP | 10-254410 | | 9/1998 |
| JP | 11-202295 | | 7/1999 |
| JP | 11-219146 | | 8/1999 |
| JP | 11 231805 | | 8/1999 |
| JP | 11-282419 | | 10/1999 |
| JP | 2000-056847 | | 2/2000 |
| JP | 2000-81607 | | 3/2000 |
| JP | 2001-134217 | | 5/2001 |
| JP | 2001-195014 | | 7/2001 |
| JP | 2002-055654 | | 2/2002 |
| JP | 2002-91376 | | 3/2002 |
| JP | 2002-514320 | | 5/2002 |
| JP | 2002-229513 | | 8/2002 |
| JP | 2002-278513 | | 9/2002 |
| JP | 2002-333862 | | 11/2002 |
| JP | 2003-076331 | | 3/2003 |
| JP | 2003-124519 | | 4/2003 |
| JP | 2003-177709 | | 6/2003 |
| JP | 2003-271095 | | 9/2003 |
| JP | 2003-308046 | | 10/2003 |
| JP | 2003-317944 | | 11/2003 |
| JP | 2004-004675 | | 1/2004 |
| JP | 2004-045648 | | 2/2004 |
| JP | 2004-145197 | | 5/2004 |
| JP | 2004-287345 | | 10/2004 |
| JP | 2005-057217 | | 3/2005 |
| JP | 2007-065015 | | 3/2007 |
| JP | 2007-155754 | | 6/2007 |
| JP | 2008-102335 | | 5/2008 |
| JP | 4-158570 | | 10/2008 |
| JP | 2003-195813 | | 7/2013 |
| KR | 2004-0100887 | | 12/2004 |
| TW | 342486 | | 10/1998 |
| TW | 473622 | | 1/2002 |
| TW | 485337 | | 5/2002 |
| TW | 502233 | | 9/2002 |
| TW | 538650 | | 6/2003 |
| TW | 1221268 | | 9/2004 |
| TW | 1223092 | | 11/2004 |
| TW | 200727247 | | 7/2007 |
| WO | WO 1998/48403 | | 10/1998 |
| WO | WO 1999/48079 | | 9/1999 |
| WO | WO 2001/06484 | | 1/2001 |
| WO | WO 2001/27910 | A1 | 4/2001 |
| WO | WO 2001/63587 | A2 | 8/2001 |
| WO | WO 2002/067327 | A | 8/2002 |
| WO | WO 2003/001496 | A1 | 1/2003 |
| WO | WO 2003/034389 | A | 4/2003 |
| WO | WO 2003/058594 | A1 | 7/2003 |
| WO | WO 2003/063124 | | 7/2003 |
| WO | WO 2003/077231 | | 9/2003 |
| WO | WO 2004/003877 | | 1/2004 |
| WO | WO 2004/025615 | A | 3/2004 |
| WO | WO 2004/034364 | | 4/2004 |
| WO | WO 2004/047058 | | 6/2004 |
| WO | WO 2004/066249 | A1 | 8/2004 |
| WO | WO 2004/104975 | A1 | 12/2004 |
| WO | WO 2005/022498 | | 3/2005 |
| WO | WO 2005/022500 | A | 3/2005 |
| WO | WO 2005/029455 | | 3/2005 |
| WO | WO 2005/029456 | | 3/2005 |
| WO | WO/2005/034072 | A1 | 4/2005 |
| WO | WO 2005/055185 | | 6/2005 |
| WO | WO 2006/000101 | A1 | 1/2006 |
| WO | WO 2006/053424 | | 5/2006 |
| WO | WO 2006/063448 | A | 6/2006 |
| WO | WO 2006/084360 | | 8/2006 |
| WO | WO 2007/003877 | A | 1/2007 |
| WO | WO 2007/079572 | | 7/2007 |
| WO | WO 2007/120849 | A2 | 10/2007 |
| WO | WO 2009/048618 | | 4/2009 |
| WO | WO 2009/055920 | | 5/2009 |
| WO | WO 2010/023270 | | 3/2010 |
| WO | WO 2010/146707 | A1 | 12/2010 |
| WO | WO 2011/041224 | A1 | 4/2011 |
| WO | WO 2011/064761 | A1 | 6/2011 |
| WO | WO 2011/067729 | | 6/2011 |
| WO | WO 2012/160424 | A1 | 11/2012 |
| WO | WO 2012/160471 | | 11/2012 |
| WO | WO 2012/164474 | A2 | 12/2012 |
| WO | WO 2012/164475 | A2 | 12/2012 |

OTHER PUBLICATIONS

Alexander : "Pixel circuits and drive schemes for glass and elastic AMOLED displays"; dated Jul. 2005 (9 pages).
Alexander : "Unique Electrical Measurement Technology for Compensation, Inspection, and Process Diagnostics of AMOLED HDTV"; dated May 2010 (4 pages).
Ashtiani : "AMOLED Pixel Circuit With Electronic Compensation of Luminance Degradation"; dated Mar. 2007 (4 pages).
Chaji : "A Current-Mode Comparator for Digital Calibration of Amorphous Silicon AMOLED Displays"; dated Jul. 2008 (5 pages).
Chaji : "A fast settling current driver based on the CCII for AMOLED displays"; dated Dec. 2009 (6 pages).
Chaji : "A Low-Cost Stable Amorphous Silicon AMOLED Display with Full V~T- and V~O~L~E~D Shift Compensation"; dated May 2007 (4 pages).
Chaji : "A low-power driving scheme for a-Si:H active-matrix organic light-emitting diode displays"; dated Jun. 2005 (4 pages).
Chaji : "A low-power high-performance digital circuit for deep submicron technologies"; dated Jun. 2005 (4 pages).
Chaji : "A novel a-Si:H AMOLED pixel circuit based on short-term stress stability of a-Si:H TFTs"; dated Oct. 2005 (3 pages).
Chaji : "A Novel Driving Scheme and Pixel Circuit for AMOLED Displays"; dated Jun. 2006 (4 pages).
Chaji : "A Novel Driving Scheme for High Resolution Large-area a-Si:H AMOLED displays"; dated Aug. 2005 (3 pages).
Chaji : "A Stable Voltage-Programmed Pixel Circuit for a-Si:H AMOLED Displays"; dated Dec. 2006 (12 pages).
Chaji : "A Sub-μA fast-settling current-programmed pixel circuit for AMOLED displays"; dated Sep. 2007.
Chaji : "An Enhanced and Simplified Optical Feedback Pixel Circuit for AMOLED Displays"; dated Oct. 2006.
Chaji : "Compensation technique for DC and transient instability of thin film transistor circuits for large-area devices"; dated Aug. 2008.
Chaji : "Driving scheme for stable operation of 2-TFT a-Si AMOLED pixel"; dated Apr. 2005 (2 pages).
Chaji : "Dynamic-effect compensating technique for stable a-Si:H AMOLED displays"; dated Aug. 2005 (4 pages).
Chaji : "Electrical Compensation of OLED Luminance Degradation"; dated Dec. 2007.
Chaji : "eUTDSP: a design study of a new VLIW-based DSP architecture"; dated May 2003 (4 pages).
Chaji : "Fast and Offset-Leakage Insensitive Current-Mode Line Driver for Active Matrix Displays and Sensors"; dated Feb. 2009 (8 pages).
Chaji : "High Speed Low Power Adder Design With a New Logic Style: Pseudo Dynamic Logic (SDL)"; dated Oct. 2001 (4 pages).
Chaji : "High-precision, fast current source for large-area current-programmed a-Si flat panels"; dated Sep. 2006 (4 pages).
Chaji : "Low-Cost AMOLED Television with IGNIS Compensating Technology"; dated May 2008 (4 pages).
Chaji : "Low-Cost Stable a-Si:H AMOLED Display for Portable Applications"; dated Jun. 2006 (4 pages).

(56) References Cited

OTHER PUBLICATIONS

Chaji : "Low-Power Low-Cost Voltage-Programmed a-Si:H AMOLED Display"; dated Jun. 2008 (5 pages).
Chaji : "Merged phototransistor pixel with enhanced near infrared response and flicker noise reduction for biomolecular imaging"; dated Nov. 2008 (3 pages).
Chaji : "Parallel Addressing Scheme for Voltage-Programmed Active-Matrix OLED Displays"; dated May 2007 (6 pages).
Chaji : "Pseudo dynamic logic (SDL): a high-speed and low-power dynamic logic family"; dated 2002 (4 pages).
Chaji : "Stable a-Si:H circuits based on short-term stress stability of amorphous silicon thin film transistors"; dated May 2006 (4 pages).
Chaji : "Stable Pixel Circuit for Small-Area High-Resolution a-Si:H AMOLED Displays"; dated Oct. 2008 (6 pages).
Chaji : "Stable RGBW AMOLED display with OLED degradation compensation using electrical feedback"; dated Feb. 2010 (2 pages).
Chaji : "Thin-Film Transistor Integration for Biomedical Imaging and AMOLED Displays"; dated 2008 (177 pages).
European Search Report for Application No. EP 04 78 6661 dated Mar. 9, 2009.
European Search Report for Application No. EP 05 75 9141 dated Oct. 30, 2009 (2 pages).
European Search Report for Application No. EP 05 81 9617 dated Jan. 30, 2009.
European Search Report for Application No. EP 06 70 5133 dated Jul. 18, 2008.
European Search Report for Application No. EP 06 72 1798 dated Nov. 12, 2009 (2 pages).
European Search Report for Application No. EP 07 71 0608.6 dated Mar. 19, 2010 (7 pages).
European Search Report for Application No. EP 07 71 9579 dated May 20, 2009.
European Search Report for Application No. EP 07 81 5784 dated Jul. 20, 2010 (2 pages).
European Search Report for Application No. EP 10 16 6143, dated Sep. 3, 2010 (2 pages).
European Search Report for Application No. EP 10 83 4294.0/1903, dated Apr. 8, 2013, (9 pages).
European Supplementary Search Report for Application No. EP 04 78 6662 dated Jan. 19, 2007 (2 pages).
Extended European Search Report for Application No. 11 73 9485.8 dated Aug. 6, 2013 (14 pages).
Extended European Search Report for Application No. EP 09 73 3076.5, dated Apr. 27, (13 pages).
Extended European Search Report for Application No. EP 11 16 8677.0, dated Nov. 29, 2012, (13 page).
Extended European Search Report for Application No. EP 11 19 1641.7 dated Jul. 11, 2012 (14 pages).
Extended European Search Report for Application No. EP 10834297 dated Oct. 27, 2014 (6 pages).
Fossum, Eric R.. "Active Pixel Sensors: Are CCD's Dinosaurs?" SPIE: Symposium on Electronic Imaging. Feb. 1, 1993 (13 pages).
Goh , "A New a-Si:H Thin-Film Transistor Pixel Circuit for Active-Matrix Organic Light-Emitting Diodes", IEEE Electron Device Letters, vol. 24, No. 9, Sep. 2003, pp. 583-585.
International Preliminary Report on Patentability for Application No. PCT/CA2005/001007 dated Oct. 16, 2006, 4 pages.
International Search Report for Application No. PCT/CA2004/001741 dated Feb. 21, 2005.
International Search Report for Application No. PCT/CA2004/001742, Canadian Patent Office, dated Feb. 21, 2005 (2 pages).
International Search Report for Application No. PCT/CA2005/001007 dated Oct. 18, 2005.
International Search Report for Application No. PCT/CA2005/001897, dated Mar. 21, 2006 (2 pages).
International Search Report for Application No. PCT/CA2007/000652 dated Jul. 25, 2007.
International Search Report for Application No. PCT/CA2009/000501, dated Jul. 30, 2009 (4 pages).
International Search Report for Application No. PCT/CA2009/001769, dated Apr. 8, 2010 (3 pages).
International Search Report for Application No. PCT/IB2010/055481, dated Apr. 7, 2011, 3 pages.
International Search Report for Application No. PCT/IB2010/055486, dated Apr. 19, 2011, 5 pages.
International Search Report for Application No. PCT/IB2014/060959, dated Aug. 28, 2014, 5 pages.
International Search Report for Application No. PCT/IB2010/055541 filed Dec. 1, 2010, dated May 26, 2011; 5 pages.
International Search Report for Application No. PCT/IB2011/050502, dated Jun. 27, 2011 (6 pages).
International Search Report for Application No. PCT/IB2011/051103, dated Jul. 8, 2011, 3 pages.
International Search Report for Application No. PCT/IB2011/055135, Canadian Patent Office, dated Apr. 16, 2012 (5 pages).
International Search Report for Application No. PCT/IB2012/052372, dated Sep. 12, 2012 (3 pages).
International Search Report for Application No. PCT/IB2013/054251, Canadian Intellectual Property Office, dated Sep. 11, 2013; (4 pages).
International Search Report for Application No. PCT/JP02/09668, dated Dec. 3, 2002, (4 pages).
International Written Opinion for Application No. PCT/CA2004/001742, Canadian Patent Office, dated Feb. 21, 2005 (5 pages).
International Written Opinion for Application No. PCT/CA2005/001897, dated Mar. 21, 2006 (4 pages).
International Written Opinion for Application No. PCT/CA2009/000501 dated Jul. 30, 2009 (6 pages).
International Written Opinion for Application No. PCT/IB2010/055481, dated Apr. 7, 2011, 6 pages.
International Written Opinion for Application No. PCT/IB2010/055486, dated Apr. 19, 2011, 8 pages.
International Written Opinion for Application No. PCT/IB2010/055541, dated May 26, 2011; 6 pages.
International Written Opinion for Application No. PCT/IB2011/050502, dated Jun. 27, 2011 (7 pages).
International Written Opinion for Application No. PCT/IB2011/051103, dated Jul. 8, 2011, 6 pages.
International Written Opinion for Application No. PCT/IB2011/055135, Canadian Patent Office, dated Apr. 16, 2012 (5 pages).
International Written Opinion for Application No. PCT/IB2012/052372, dated Sep. 12, 2012 (6 pages).
International Written Opinion for Application No. PCT/IB2013/054251, Canadian Intellectual Property Office, dated Sep. 11, 2013; (5 pages).
Jafarabadiashtiani : "A New Driving Method for a-Si AMOLED Displays Based on Voltage Feedback"; dated 2005 (4 pages).
Kanicki, J., "Amorphous Silicon Thin-Film Transistors Based Active-Matrix Organic Light-Emitting Displays." Asia Display: International Display Workshops, Sep. 2001 (pp. 315-318).
Karim, K. S., "Amorphous Silicon Active Pixel Sensor Readout Circuit for Digital Imaging." IEEE: Transactions on Electron Devices. vol. 50, No. 1, Jan. 2003 (pp. 200-208).
Lee : "Ambipolar Thin-Film Transistors Fabricated by PECVD Nanocrystalline Silicon"; dated 2006.
Lee, Wonbok: "Thermal Management in Microprocessor Chips and Dynamic Backlight Control in Liquid Crystal Displays", Ph.D. Dissertation, University of Southern California (124 pages).
Liu, P. et al., Innovative Voltage Driving Pixel Circuit Using Organic Thin-Film Transistor for AMOLEDs, Journal of Display Technology, vol. 5, Issue 6, Jun. 2009 (pp. 224-227).
Ma E Y: "organic light emitting diode/thin film transistor integration for foldable displays" dated Sep. 15, 1997(4 pages).
Matsueda y : "35.1: 2.5-in. AMOLED with Integrated 6-bit Gamma Compensated Digital Data Driver"; dated May 2004.
Mendes E., "A High Resolution Switch-Current Memory Base Cell." IEEE: Circuits and Systems. vol. 2, Aug. 1999 (pp. 718-721).
Nathan A. , "Thin Film imaging technology on glass and plastic" ICM 2000, proceedings of the 12 international conference on microelectronics, dated Oct. 31, 2001 (4 pages).

(56) References Cited

OTHER PUBLICATIONS

Nathan , "Amorphous Silicon Thin Film Transistor Circuit Integration for Organic LED Displays on Glass and Plastic", IEEE Journal of Solid-State Circuits, vol. 39, No. 9, Sep. 2004, pp. 1477-1486.
Nathan : "Backplane Requirements for active Matrix Organic Light Emitting Diode Displays,"; dated 2006 (16 pages).
Nathan : "Call for papers second international workshop on compact thin-film transistor (TFT) modeling for circuit simulation"; dated Sep. 2009 (1 page).
Nathan : "Driving schemes for a-Si and LTPS AMOLED displays"; dated Dec. 2005 (11 pages).
Nathan : "Invited Paper: a-Si for AMOLED—Meeting the Performance and Cost Demands of Display Applications (Cell Phone to HDTV)"; dated 2006 (4 pages).
Office Action in Japanese patent application No. JP2012-541612 dated Jul. 15, 2014. (3 pages).
Partial European Search Report for Application No. EP 11 168 677.0, dated Sep. 22, 2011 (5 pages).
Partial European Search Report for Application No. EP 11 19 1641.7, dated Mar. 20, 2012 (8 pages).
Philipp: "Charge transfer sensing" Sensor Review, vol. 19, No. 2, Dec. 31, 1999 (Dec. 31, 1999), 10 pages.
Rafati : "Comparison of a 17 b multiplier in Dual-rail domino and in Dual-rail D L (D L) logic styles"; dated 2002 (4 pages).
Safavian : "3-TFT active pixel sensor with correlated double sampling readout circuit for real-time medical x-ray imaging"; dated Jun. 2006 (4 pages).
Safavian : "A novel current scaling active pixel sensor with correlated double sampling readout circuit for real time medical x-ray imaging"; dated May 2007 (7 pages).
Safavian : "A novel hybrid active-passive pixel with correlated double sampling CMOS readout circuit for medical x-ray imaging"; dated May 2008 (4 pages).
Safavian : "Self-compensated a-Si:H detector with current-mode readout circuit for digital X-ray fluoroscopy"; dated Aug. 2005 (4 pages).
Safavian : "TFT active image sensor with current-mode readout circuit for digital x-ray fluoroscopy [5969D-82]"; dated Sep. 2005 (9 pages).
Safavian : "Three-TFT image sensor for real-time digital X-ray imaging"; dated Feb. 2, 2006 (2 pages).
Singh "Current Conveyor: Novel Universal Active Block", Samriddhi, S-JPSET vol. I, Issue 1, 2010, pp. 41-48.
Smith, Lindsay I., "A tutorial on Principal Components Analysis," dated Feb. 26, 2001 (27 pages).
Spindler , System Considerations for RGBW OLED Displays, Journal of the SID 14/1, 2006, pp. 37-48.
Stewart M. "polysilicon TFT technology for active matrix Oled displays" IEEE transactions on electron devices, vol. 48, No. 5, dated May 2001 (7 pages).
Vygranenko : "Stability of indium-oxide thin-film transistors by reactive ion beam assisted deposition"; dated 2009.
Wang : "Indium oxides by reactive ion beam assisted evaporation: From material study to device application"; dated Mar. 2009 (6 pages).
Yi He , "Current-Source a-Si:H Thin Film Transistor Circuit for Active-Matrix Organic Light-Emitting Displays", IEEE Electron Device Letters, vol. 21, No. 12, Dec. 2000, pp. 590-592.
Yu, Jennifer: "Improve OLED Technology for Display", Ph.D. Dissertation, Massachusetts Institute of Technology, Sep. 2008 (151 pages).
International Search Report for Application No. PCT/IB2014/058244, Canadian Intellectual Property Office, dated Apr. 11, 2014; (6 pages).
International Search Report for Application No. PCT/IB2014/059753, Canadian Intellectual Property Office, dated Jun. 23, 2014; (6 pages).
Written Opinion for Application No. PCT/IB2014/059753, Canadian Intellectual Property Office, dated Jun. 12, 2014 (6 pages).
International Search Report for Application No. PCT/IB2014/060879, Canadian Intellectual Property Office, dated Jul. 17, 2014 (3 pages).
Extended European Search Report for Application No. EP 14158051.4, dated Jul. 29, 2014, (4 pages).
Office Action in Chinese Patent Invention No. 201180008188.9, dated Jun. 4, 2014 (17 pages) (w/English translation).
International Search Report for Application No. PCT/IB/2014/066932 dated Mar. 24, 2015.
Written Opinion for Application No. PCT/IB/2014/066932 dated Mar. 24, 2015.
Extended European Search Report for Application No. EP 11866291.5, dated Mar. 9, 2015, (9 pages).
Extended European Search Report for Application No. EP 14181848.4, dated Mar. 5, 2015, (8 pages).
Office Action in Chinese Patent Invention No. 201280022957.5, dated Jun. 26, 2015 (7 pages).
Extended European Search Report for Application No. EP 13794695.0, dated Dec. 18, 2015, (9 pages).
Extended European Search Report for Application No. EP 16157746.5, dated Apr. 8, 2016, (11 pages).
Extended European Search Report for Application No. EP 16192749.6, dated Dec. 15, 2016, (17 pages).
International Search Report for Application No. PCT/IB/2016/054763 dated Nov. 25, 2016 (4 pages).
Written Opinion for Application No. PCT/IB/2016/054763 dated Nov. 25, 2016 (9 pages).

* cited by examiner

SYSTEMS AND METHODS OF OPTICAL FEEDBACK

CROSS-REFERENCE TO RELATED APPLICATION(S)

This application claims priority to Canadian Application No. 2,889,870, filed May 4, 2015, which is hereby incorporated by reference herein in its entirety.

FIELD OF THE INVENTION

The present disclosure relates to optically measuring and calibrating light emissive visual display technology, and particularly to optical feedback systems and methods for pixel identification, evaluation, and calibration for active matrix light emitting diode device (AMOLED) and other emissive displays.

BRIEF SUMMARY

According to a first aspect there is provided an optical feedback method for calibrating an emissive display system having pixels, each pixel having a light-emitting device, the method comprising: iteratively performing a calibration loop until a number of pixels of the display determined to be uncalibrated is less than a threshold number of pixels, the calibration loop comprising: measuring the luminance of pixels of the display generating luminance measurements for each pixel; comparing luminance measurements for the pixels with reference values generating a difference value for each pixel measured; determining for each pixel whether the difference value exceeds a difference threshold, and for pixels having a difference value which does not exceed the difference threshold determining the pixel to be calibrated and storing currently used calibration data for the pixel as final calibration data for the pixel, and for pixels having a difference value which exceeds the difference threshold determining the pixel to be uncalibrated and adjusting the calibration data for the pixel with use of the luminance measurement for the pixel and the previous calibration data for the pixel; and programming each pixel whose calibration data was adjusted with the adjusted calibration data.

In some embodiments, measuring the luminance of pixels of the display comprises identifying the pixels of the display comprising: activating at least one pixel of the display for luminance measurement; generating a luminance measurement image of the pixels of the display after activating the at least one pixel; identifying pixels of the display from the variation in luminance in the luminance measurement image; and extracting luminance data for each pixel identified at a position within the luminance measurement image with use of the luminance data along at least one luminance profile passing through the position within the luminance measurement image to generate said luminance measurement for said pixel.

In some embodiments, activating the at least one pixel of the display comprises activating a sparse pixel pattern wherein between any two pixels activated for luminance measurement there is at least on pixel which is inactive, thereby providing luminance measurement data corresponding to a black area between the two pixels along the at least one luminance profile.

In some embodiments, wherein activating the number of pixels of the display comprises activating a multichannel sparse pixel pattern wherein more than one channel of pixels is activated simultaneously and between any two pixels activated of any channel for luminance measurement there is at least on pixel of that channel which is inactive, thereby providing a luminance measurement data corresponding to a black area of that channel between the two pixels along the at least one luminance profile.

Some embodiments further provide for identifying defective pixels unresponsive to changes in calibration data for the defective pixels; correcting the luminance measurement image after generated for anomalies; and calibrating an optical sensor used for measuring the luminance of pixels of the display prior to measuring the luminance of pixels of the display.

Some embodiments further provide for prior to iteratively performing the calibration loop: programming each of the pixels of the display with at least two unique values; measuring the luminance of the pixels corresponding to each programmed unique value, generating coarse input-output characteristics for each pixel; generating calibration data for each pixel based on the coarse input-output characteristics for each pixel; and programming each of the pixels of the display with the calibration data for the pixel.

According to another aspect there is provided an optical feedback system for calibrating an emissive display system having pixels, each pixel having a light-emitting device, the system comprising: a display panel comprising said pixels; an optical sensor operative to measure luminance of pixels of the display panel; optical feedback processing coupled to the optical sensor; and a controller of the emissive display system coupled to said optical feedback processing and for iteratively controlling a calibration loop until a number of pixels of the display panel determined to be uncalibrated is less than a threshold number of pixels, iteratively controlling the calibration loop comprising: controlling the optical sensor and the optical feedback processing to measure the luminance of pixels of the display panel generating luminance measurements for each pixel; controlling the optical feedback processing to compare luminance measurements for the pixels with reference values generating a difference value for each pixel measured; controlling the optical feedback processing to determine for each pixel whether the difference value exceeds a difference threshold, and for pixels having a difference value which does not exceed the difference threshold to determine the pixel to be calibrated and store currently used calibration data for the pixel as final calibration data for the pixel, and for pixels having a difference value which exceeds the difference threshold to determine the pixel to be uncalibrated and adjust the calibration data for the pixel with use of the luminance measurement for the pixel and the previous calibration data for the pixel; and programming each pixel whose calibration data was adjusted with the adjusted calibration data.

In some embodiments, the controller's controlling of the optical sensor and the optical feedback processing to measure the luminance of pixels of the display panel comprises controlling identification of the pixels of the display panel comprising: activating at least one pixel of the display panel for luminance measurement; controlling the optical sensor and optical feedback processing to generate a luminance measurement image of the pixels of the display panel after activating the at least one pixel; controlling the optical feedback processing to identify pixels of the display panel from the variation in luminance in the luminance measurement image; and controlling the optical feedback processing to extract luminance data for each pixel identified at a position within the luminance measurement image with use of the luminance data along at least one luminance profile passing through the position within the luminance measurement image to generate said luminance measurement for said pixel.

In some embodiments, the controller's activating the at least one pixel of the display comprises activating a sparse pixel pattern wherein between any two pixels activated for luminance measurement there is at least on pixel which is inactive, thereby providing luminance measurement data corresponding to a black area between the two pixels along the at least one luminance profile.

In some embodiments, the controller's activating the number of pixels of the display comprises activating a multichannel sparse pixel pattern wherein more than one channel of pixels is activated simultaneously and between any two pixels activated of any channel for luminance measurement there is at least on pixel of that channel which is inactive, thereby providing a luminance measurement data corresponding to a black area of that channel between the two pixels along the at least one luminance profile.

In some embodiments, the optical sensor is calibrated prior being used for measuring the luminance of pixels of the display, and wherein the controller is further for: controlling the optical feedback processing to identify defective pixels unresponsive to changes in calibration data for the defective pixels; and controlling the optical feedback processing to correct the luminance measurement image after generated for anomalies.

In some embodiments, the controller is further for prior to iteratively performing the calibration loop: programming each of the pixels of the display with at least two unique values; controlling the optical sensor and the optical feedback processing to measure the luminance of the pixels corresponding to each programmed unique value, to generate coarse input-output characteristics for each pixel; generating calibration data for each pixel based on the coarse input-output characteristics for each pixel; and programming each of the pixels of the display with the calibration data for the pixel.

The foregoing and additional aspects and embodiments of the present disclosure will be apparent to those of ordinary skill in the art in view of the detailed description of various embodiments and/or aspects, which is made with reference to the drawings, a brief description of which is provided next.

BRIEF DESCRIPTION OF THE DRAWINGS

The foregoing and other advantages of the disclosure will become apparent upon reading the following detailed description and upon reference to the drawings.

Figure 1:
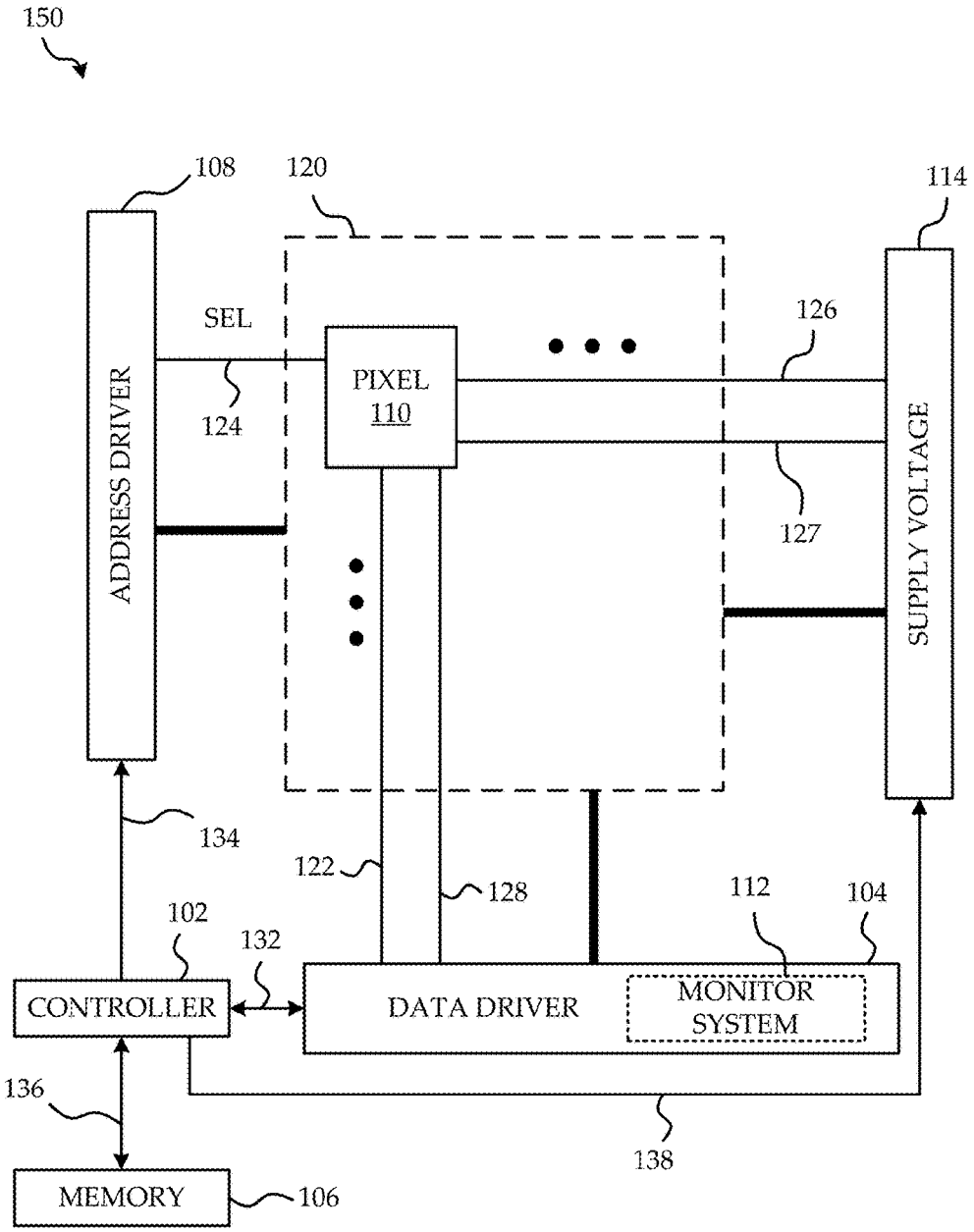
FIG. 1 illustrates an example display system which participates in and whose pixels are to be measured and calibrated by the optical feedback systems and methods disclosed.

While the present disclosure is susceptible to various modifications and alternative forms, specific embodiments or implementations have been shown by way of example in the drawings and will be described in detail herein. It should be understood, however, that the disclosure is not intended to be limited to the particular forms disclosed. Rather, the disclosure is to cover all modifications, equivalents, and alternatives falling within the spirit and scope of an invention as defined by the appended claims.

DETAILED DESCRIPTION

Many modern display technologies suffer from defects, variations, and non-uniformities, from the moment of fabrication, and can suffer further from aging and deterioration over the operational lifetime of the display, which result in the production of images which deviate from those which are intended. Optical feedback systems and methods can be used, either during fabrication or after a display has been put into use, to measure and calibrate pixels (and sub-pixels) whose output luminance varies from the expected luminance. One challenge with optical feedback systems is how to correct for errors in pixel luminance at the pixel level rather than at the display level or at the level of multi-pixel subareas areas of the display. Also, if the non-uniformity in the system is high, each pixel will have a significantly different point in the input-output response curve which will result in a significantly different propagation error in the extracted input-output curve based on the measurement points. For example, when similar inputs are applied to pixels with significantly different input-output curves, such as one pixel having a very week input-output curve (e.g. having a very high threshold voltage or a very low gain factor) and another pixel with a very strong input-output curve (e.g. having a very small threshold voltage or a very high gain factor), significantly different outputs are created. In some cases a weak pixel may be even remain "off" for some of the input. In such cases of high non-uniformity, the noise or error in the measurement can have a significantly different effect on each pixel since the two measured output values are so far apart. Thus, the error in extracted input-output curves as the result of measurement can be significantly different. The systems and methods disclosed below address these two issues.

While the embodiments described herein will be in the context of AMOLED displays it should be understood that the optical feedback systems and methods described herein are applicable to any other display comprising pixels, including but not limited to light emitting diode displays (LED), electroluminescent displays (ELD), organic light emitting diode displays (OLED), plasma display panels (PSP), among other displays.

It should be understood that the embodiments described herein pertain to systems and methods of optical feedback and compensation and do not limit the display technology underlying their operation and the operation of the displays in which they are implemented. The systems and methods described herein are applicable to any number of various types and implementations of various visual display technologies.

FIG. 1 is a diagram of an example display system 150 implementing the methods described further below in conjunction with an arrangement with an optical sensor or array and optical feedback processing. The display system 150 includes a display panel 120, an address driver 108, a data driver 104, a controller 102, and a memory storage 106.

The display panel 120 includes an array of pixels 110 (only one explicitly shown) arranged in rows and columns. Each of the pixels 110 is individually programmable to emit light with individually programmable luminance values. The controller 102 receives digital data indicative of information to be displayed on the display panel 120. The controller 102 sends signals 132 to the data driver 104 and scheduling signals 134 to the address driver 108 to drive the pixels 110 in the display panel 120 to display the information indicated. The plurality of pixels 110 of the display panel 120 thus comprise a display array or display screen adapted to dynamically display information according to the input digital data received by the controller 102. The display screen and various subsets of its pixels define "display areas" which may be used for monitoring and managing display brightness. The display screen can display images and streams of video information from data received by the controller 102. The supply voltage 114 provides a constant power voltage or can serve as an adjustable voltage supply that is controlled by signals from the controller 102. The display system 150 can also incorporate features from a current source or sink (not shown) to provide biasing currents to the pixels 110 in the display panel 120 to thereby decrease programming time for the pixels 110.

For illustrative purposes, only one pixel 110 is explicitly shown in the display system 150 in FIG. 1. It is understood that the display system 150 is implemented with a display screen that includes an array of a plurality of pixels, such as the pixel 110, and that the display screen is not limited to a particular number of rows and columns of pixels. For example, the display system 150 can be implemented with a display screen with a number of rows and columns of pixels commonly available in displays for mobile devices, monitor-based devices, and/or projection-devices. In a multichannel or color display, a number of different types of pixels, each responsible for reproducing color of a particular channel or color such as red, green, or blue, will be present in the display. Pixels of this kind may also be referred to as "subpixels" as a group of them collectively provide a desired color at a particular row and column of the display, which group of subpixels may collectively also be referred to as a "pixel".

The pixel 110 is operated by a driving circuit or pixel circuit that generally includes a driving transistor and a light emitting device. Hereinafter the pixel 110 may refer to the pixel circuit. The light emitting device can optionally be an organic light emitting diode, but implementations of the present disclosure apply to pixel circuits having other electroluminescence devices, including current-driven light emitting devices and those listed above. The driving transistor in the pixel 110 can optionally be an n-type or p-type amorphous silicon thin-film transistor, but implementations of the present disclosure are not limited to pixel circuits having a particular polarity of transistor or only to pixel circuits having thin-film transistors. The pixel circuit 110 can also include a storage capacitor for storing programming information and allowing the pixel circuit 110 to drive the light emitting device after being addressed. Thus, the display panel 120 can be an active matrix display array.

As illustrated in FIG. 1, the pixel 110 illustrated as the top-left pixel in the display panel 120 is coupled to a select line 124, a supply line 126, a data line 122, and a monitor line 128. A read line may also be included for controlling connections to the monitor line. In one implementation, the supply voltage 114 can also provide a second supply line to the pixel 110. For example, each pixel can be coupled to a first supply line 126 charged with Vdd and a second supply line 127 coupled with Vss, and the pixel circuits 110 can be situated between the first and second supply lines to facilitate driving current between the two supply lines during an emission phase of the pixel circuit. It is to be understood that each of the pixels 110 in the pixel array of the display 120 is coupled to appropriate select lines, supply lines, data lines, and monitor lines. It is noted that aspects of the present disclosure apply to pixels having additional connections, such as connections to additional select lines, and to pixels having fewer connections.

With reference to the pixel 110 of the display panel 120, the select line 124 is provided by the address driver 108, and can be utilized to enable, for example, a programming operation of the pixel 110 by activating a switch or transistor to allow the data line 122 to program the pixel 110. The data line 122 conveys programming information from the data driver 104 to the pixel 110. For example, the data line 122 can be utilized to apply a programming voltage or a programming current to the pixel 110 in order to program the pixel 110 to emit a desired amount of luminance. The programming voltage (or programming current) supplied by the data driver 104 via the data line 122 is a voltage (or current) appropriate to cause the pixel 110 to emit light with a desired amount of luminance according to the digital data received by the controller 102. The programming voltage (or programming current) can be applied to the pixel 110 during a programming operation of the pixel 110 so as to charge a storage device within the pixel 110, such as a storage capacitor, thereby enabling the pixel 110 to emit light with the desired amount of luminance during an emission operation following the programming operation. For example, the storage device in the pixel 110 can be charged during a programming operation to apply a voltage to one or more of a gate or a source terminal of the driving transistor during the emission operation, thereby causing the driving transistor to convey the driving current through the light emitting device according to the voltage stored on the storage device.

Generally, in the pixel 110, the driving current that is conveyed through the light emitting device by the driving transistor during the emission operation of the pixel 110 is a current that is supplied by the first supply line 126 and is drained to a second supply line 127. The first supply line 126 and the second supply line 127 are coupled to the voltage supply 114. The first supply line 126 can provide a positive supply voltage (e.g., the voltage commonly referred to in circuit design as "Vdd") and the second supply line 127 can provide a negative supply voltage (e.g., the voltage commonly referred to in circuit design as "Vss"). Implementations of the present disclosure can be realized where one or the other of the supply lines (e.g., the supply line 127) is fixed at a ground voltage or at another reference voltage.

The display system 150 also includes a monitoring system 112. With reference again to the pixel 110 of the display panel 120, the monitor line 128 connects the pixel 110 to the monitoring system 112. The monitoring system 12 can be integrated with the data driver 104, or can be a separate stand-alone system. In particular, the monitoring system 112 can optionally be implemented by monitoring the current and/or voltage of the data line 122 during a monitoring operation of the pixel 110, and the monitor line 128 can be entirely omitted. The monitor line 128 allows the monitoring system 112 to measure a current or voltage associated with the pixel 110 and thereby extract information indicative of a degradation or aging of the pixel 110 or indicative of a temperature of the pixel 110. In some embodiment, display panel 120 includes temperature sensing circuitry devoted to sensing temperature implemented in the pixels 110, while in other embodiments, the pixels 110 comprise circuitry which participates in both sensing temperature and driving the pixels. For example, the monitoring system 112 can extract, via the monitor line 128, a current flowing through the driving transistor within the pixel 110 and thereby determine, based on the measured current and based on the voltages applied to the driving transistor during the measurement, a threshold voltage of the driving transistor or a shift thereof.

The monitoring system 112 can also extract an operating voltage of the light emitting device (e.g., a voltage drop across the light emitting device while the light emitting device is operating to emit light). The monitoring system 112 can then communicate signals 132 to the controller 102 and/or the memory 106 to allow the display system 150 to store the extracted aging information in the memory 106. During subsequent programming and/or emission operations of the pixel 110, the aging information is retrieved from the memory 106 by the controller 102 via memory signals 136, and the controller 102 then compensates for the extracted degradation information in subsequent programming and/or emission operations of the pixel 110. For example, once the degradation information is extracted, the programming information conveyed to the pixel 110 via the data line 122 can be appropriately adjusted during a subsequent programming operation of the pixel 110 such that the pixel 110 emits light with a desired amount of luminance that is independent of the degradation of the pixel 110. In an example, an increase in the threshold voltage of the driving transistor within the pixel 110 can be compensated for by appropriately increasing the programming voltage applied to the pixel 110.

As described further below, for embodiments disclosed herein, calibration data is directly determined during an optical feedback calibration either during fabrication or after the display has been in operation for some time, from observing the luminance of each pixel and adjusting the calibration data to produce luminance of an acceptable level. In between periodic optical feedback calibrations, further monitoring as described above as the display ages may be utilized to adjust the compensation for continual aging and other phenomena which changes throughout the operating lifetime of the display.

Figure 2A:
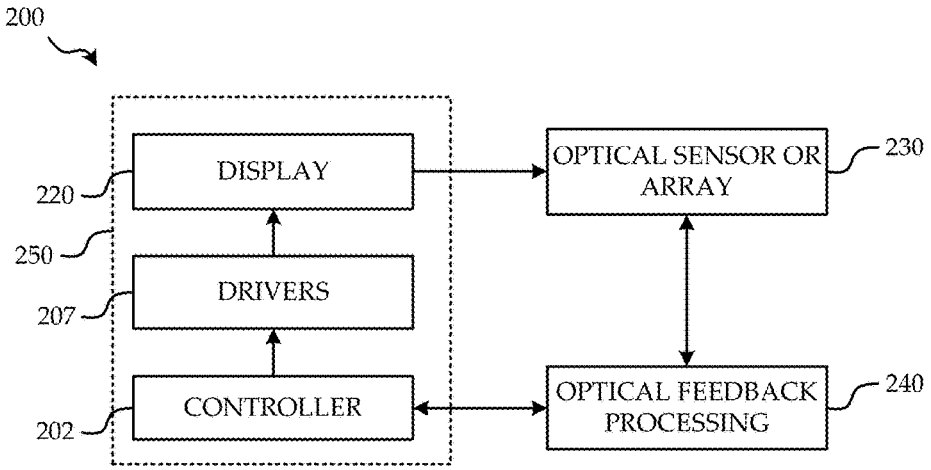
FIG. 2A is a system block diagram of an optical feedback system.

Referring to FIG. 2A, an optical feedback system 200 according to an embodiment will now be described.

The optical feedback system 200 includes display system 250 which is being calibrated an optical sensor or array 230, a controller 202 for overall control the process, which in embodiment in FIG. 2A is shown as part of the display system 250, and an optical feedback processing module 240 for controlling specific processes of the optical feedback methods. The optical feedback processing module 240 can be part of an external tool that used for example in a production factory for calibration of the displays. In another case, optical feedback processing 240 can be part of the display system and/or the controller, for example, integrated in a timing controller TCON. The display system 250 of FIG. 2A may correspond more or less to the display system 150 of FIG. 1 and includes similar components thereof, of which specifically, drivers 207, the display panel 220, and the controller 202 are shown explicitly for convenience. The controller 202 may correspond to controller 102 or controller 102 and memory 106 of FIG. 1.

The optical sensor or array 230 (hereafter "optical sensor") is arranged to measure the luminance of all of the pixels 110 of the display panel 220. The optical sensor 230 may be based on a digital photography system with or without lenses, optical scanning technology, or any other suitable optical measurement technology capable of taking optical measurements and/or generating a luminance measurement image representative of the optical output of the display panel 220. In some embodiments the optical feedback processing 240 generates the image from raw measurement data from the optical sensor 230 while in other embodiments it receives the image from the optical sensor 230. Luminance measurement image data refers to any two dimensional matrix containing optical luminance data corresponding to the output of the display panel 220, and may comprise multiple channels such as red (R), green (G), blue (B) etc. and in some cases may be monochromatic.

Figure 2B:
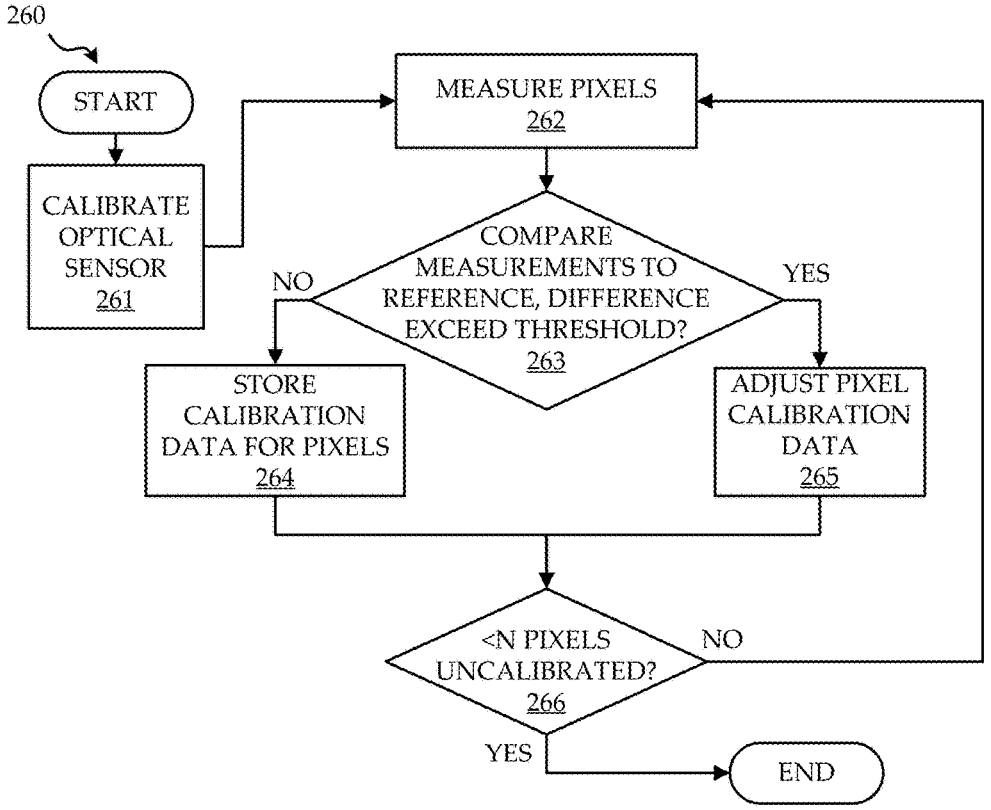
FIG. 2B is a high level functional block diagram of an optical feedback method.

With reference also to the optical feedback method 260 of FIG. 2B, prior to participation in the measurement of pixels in the optical feedback methods described herein, the optical sensor 230 is calibrated 261 to ensure accuracy of its measurements and/or to provide any sensor calibration data necessary for calibrating its output so that it may be rendered accurate. The optical sensor's 230 operation is generally controlled by the controller 202, as well as is the optical feedback processing 240.

After the optical sensor 230 measures the pixels 262, it provides the luminance measurement image data to optical feedback processing 240 which identifies the pixels in the display and extracts the luminance value of each pixel from the image. The luminance value of each pixel (or sub-pixel) is compared with a reference value 263 and if the difference does not exceed a threshold, the calibration data which was used to drive the pixel is stored as final calibration data. For each pixel which has a difference in luminance from the reference value which does exceed the threshold, calibration is deemed incomplete, and the optical feedback processing 240 adjusts the calibration data 265 for each pixel based on the measured data in a manner predicted to compensate for the difference, for retesting during another iteration of the calibration loop. Thereafter, the controller 202, which in the embodiment of FIG. 2A controls the entire process and the display 250, programs the display 250 with the new calibrated data and the process continues until the number of pixels deemed as remaining uncalibrated due to their difference in luminance from the reference values still exceeding the threshold, is less than a predefined threshold number of pixels N 266, which in some embodiments may be defined as a small percentage of the total number of pixels 110 in the display panel 220 or such that the process continues until all of the pixels have been processed.

In some embodiments, a process for identifying defective pixels 110 of the display panel 220 may be carried out for eliminating them from the rest of the calibration process of FIG. 2B. This process may be carried out at the beginning and outside of the calibration loop or may be carried out inside the calibration loop. If it is carried out outside of the calibration loop, relatively few measurements are performed to identify the pixels that do not respond to changes to the calibration data they are programmed with. While the output of working pixels change appropriately in response to changes in the calibration data used to program them, the output of defective pixels do not change enough or change too much in response to changing calibration data. Thus, if in response to being programmed with different calibration data, a pixel's output does not change, changes by an amount below a threshold minimum, or changes by an amount greater than a threshold maximum, the pixel is considered defective. If the defective pixels are identified inside the calibration loop, a defective pixel list is updated as the system identifies the pixels that do not respond to changes in the calibration data, i.e., the programming data they are programmed with.

Figure 3:
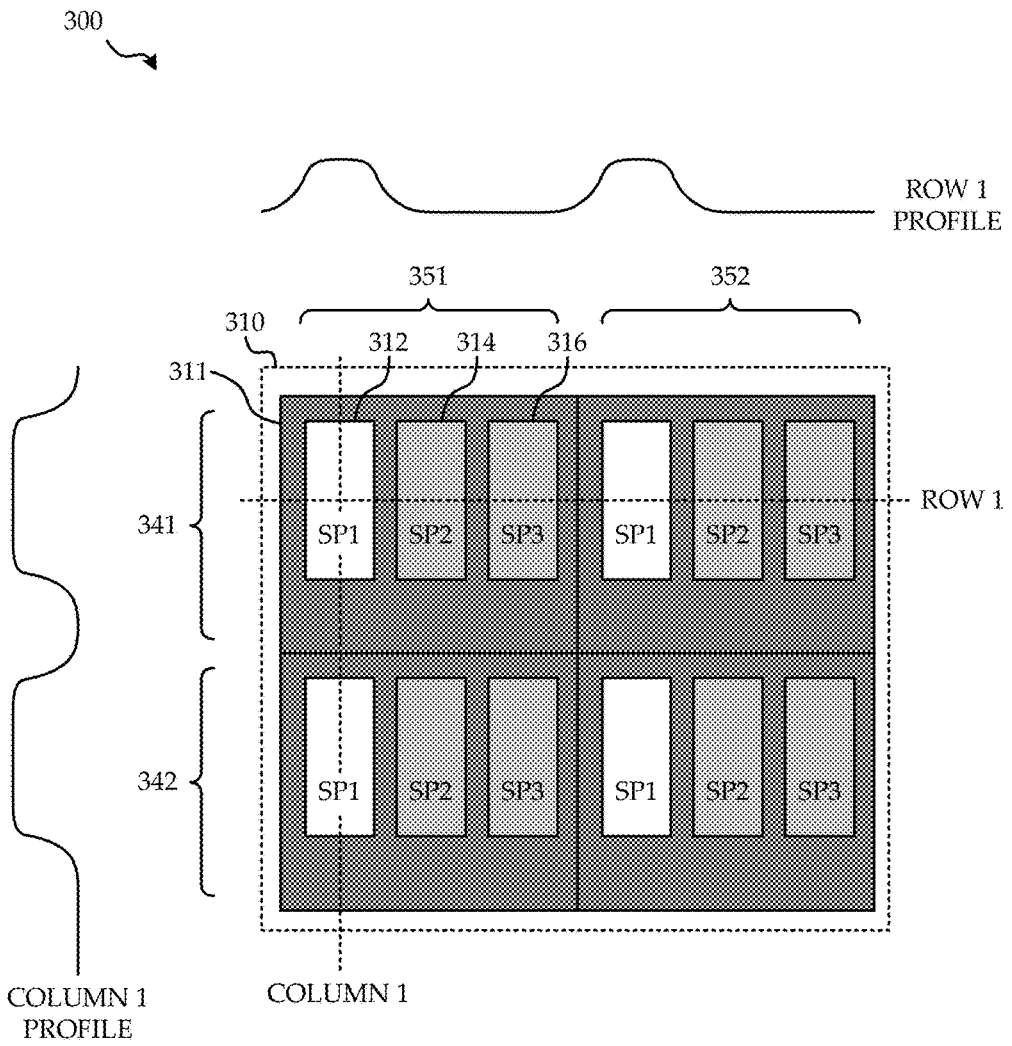
FIG. 3 illustrates pixel identification used in optical feedback according to one embodiment.

Referring to FIG. 3, pixel identification 300 used in optical feedback according to one embodiment will now be described.

To extract the luminance value of each display pixel 110, one can use a luminance profile of data from the luminance measurement image. The luminance profile corresponds to luminance data taken along a one dimensional line of the image and passing through the pixels (subpixels) of interest. FIG. 3 depicts pixels 311 (only four shown) of a display panel 310, arranged in rows 341, 342, and columns 351, 352, each pixel of which includes a first subpixel SP1 312, a second subpixel SP2 314, and a third subpixel SP3 316, each corresponding to a channel or color. Subpixels which are active are drawn in white, while subpixels which are inactive or displaying a "black" value are shown in grey. Two luminance profiles are shown for purposes of illustration. "Row 1 Profile" depicts luminance data along the line passing through Row 1 and all of the subpixels therein, which data reveals two active subpixels along that portion of row 1 separated by black space. "Column 1 Profile" depicts luminance data along the line passing through Column 1, but only though the first subpixel SP1 of each pixel of the column, which data reveals two active subpixels along that portion of column 1 separated by black space. Although the luminance profiles are shown as taken from specific lines passing through subpixels in the specific arrangement they are in in FIG. 3, it is to be understood that lines through the luminance measurement image data may be appropriately determined given any number and arrangement of subpixels in the pixels. In the embodiment of FIG. 3, each channel and their corresponding subpixels is measured separately, as can be seen by activation only of the first subpixels SP1 of each of the pixels of the display. This is suitable for monochromatic or color capable optical sensors. In other embodiments all channels i.e. subpixels are measured simultaneously by a color capable optical sensor 230 and some form of filtering or processing may be used to isolate subpixels by color if desired.

The luminance measurement image will have black areas between each pixel (sub-pixel) and the difference between the black area and the pixel can be used to identify the pixel areas. Locating the pixel positions within the luminance measurement data allow for proper determination of the luminance value (often corresponding to the value at or about the center of the subpixel) and identification of the particular pixel within the display panel to associate with that value. The luminance data profiles along lines through the active pixels are illustrative of this. The main challenges with this technique are that the edges are blurred and often for high resolution and/or high density displays the pixels (and subpixels) are too close.

Figure 4:
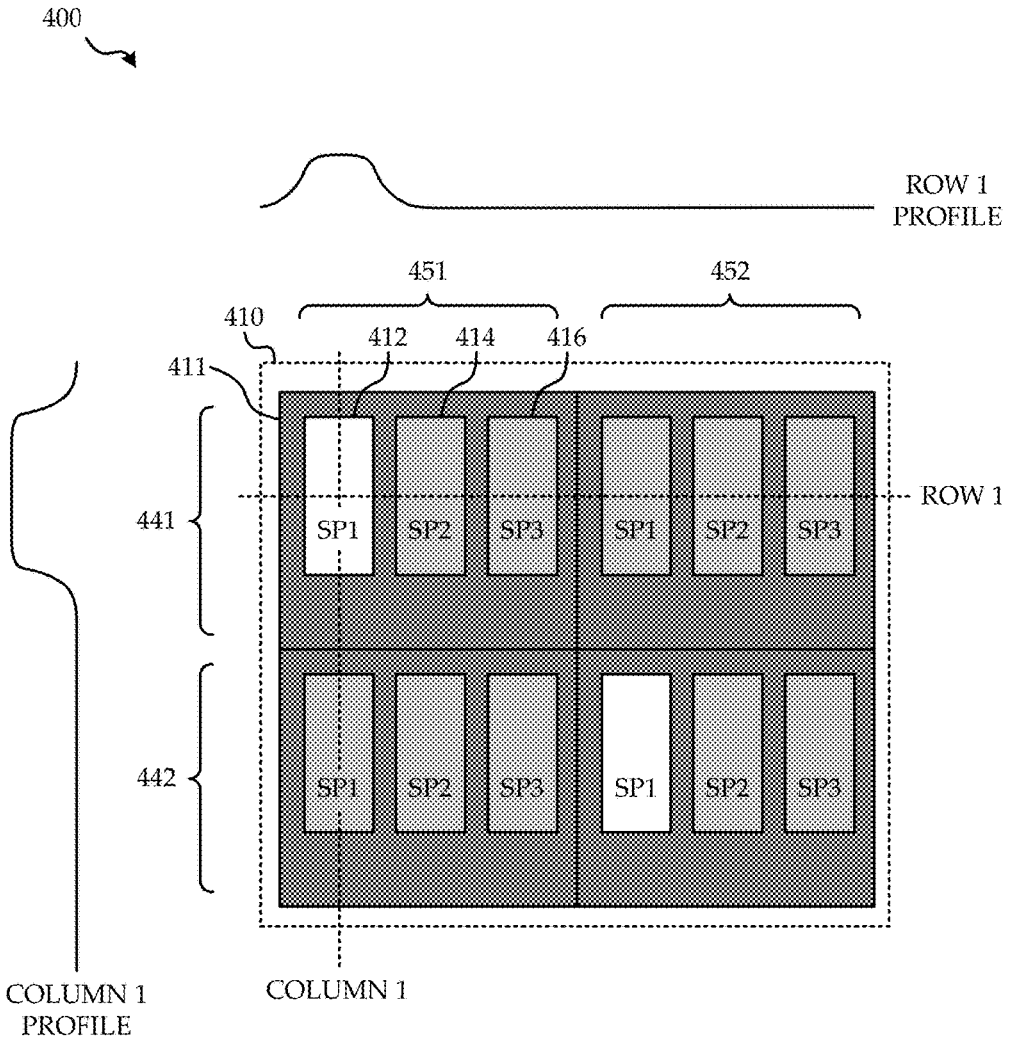
FIG. 4 illustrates pixel identification used in optical feedback according to an embodiment utilizing sparse activation.

Referring to FIG. 4, pixel identification 400 used in optical feedback according to an embodiment utilizing sparse activation will now be described. In cases where the black areas between adjacent pixels would be insufficient, activation of pixels during each calibration loop is performed with use of a subset of pixels, ensuring some pixels are off to provide the needed extra black spaces. Various sparse pixel activation patterns may be used including but not limited to a checkerboard pattern of alternatively on and off pixels as depicted in FIG. 4. Generally speaking, any sparse pattern which provides at least one inactive pixel between two active pixels whose luminances are being measured provides useful extra black area. Depending upon the density and resolution of the display more black area between pixels may be needed. Using a sparse pattern is particularly useful if the spatial resolution of the luminance measurement image producible by the optical sensor 230 is too low to properly resolve active subpixels sufficiently close to each other.

Although sparse pattern activation such as the checkerboard pattern of FIG. 4 makes identifying the pixels (subpixel) much easier, the calibration time will increase. Since only a subset of pixels is measured at any one time, the calibration loop needs to be repeated for different pixels at different times.

FIG. 4 depicts pixels 411 (only four shown) of a display panel 410, arranged in rows 441, 442, and columns 451, 452, each pixel of which includes a first subpixel SP1 412, a second subpixel SP2 414, and a third subpixel SP3 416, each corresponding to a channel or color. Subpixels which are active are drawn in white, while subpixels which are inactive or displaying a "black" value are shown in grey. Two luminance profiles are shown for purposes of illustration. "Row 1 Profile" depicts luminance data along the line passing through Row 1 and all of the subpixels therein, which data reveals only one active subpixel along that portion of row 1 followed by a black space. "Column 1 Profile" depicts luminance data along the line passing through Column 1, but only though the first subpixel SP1 of each pixel of the column, which data reveals only one subpixel along that portion of column 1 followed by a black space. As was the case for the embodiment depicted in FIG. 3, each channel and their corresponding subpixels is measured separately, as can be seen by activation only of the first subpixels SP1 of each of the pixels of the display.

Figure 5:
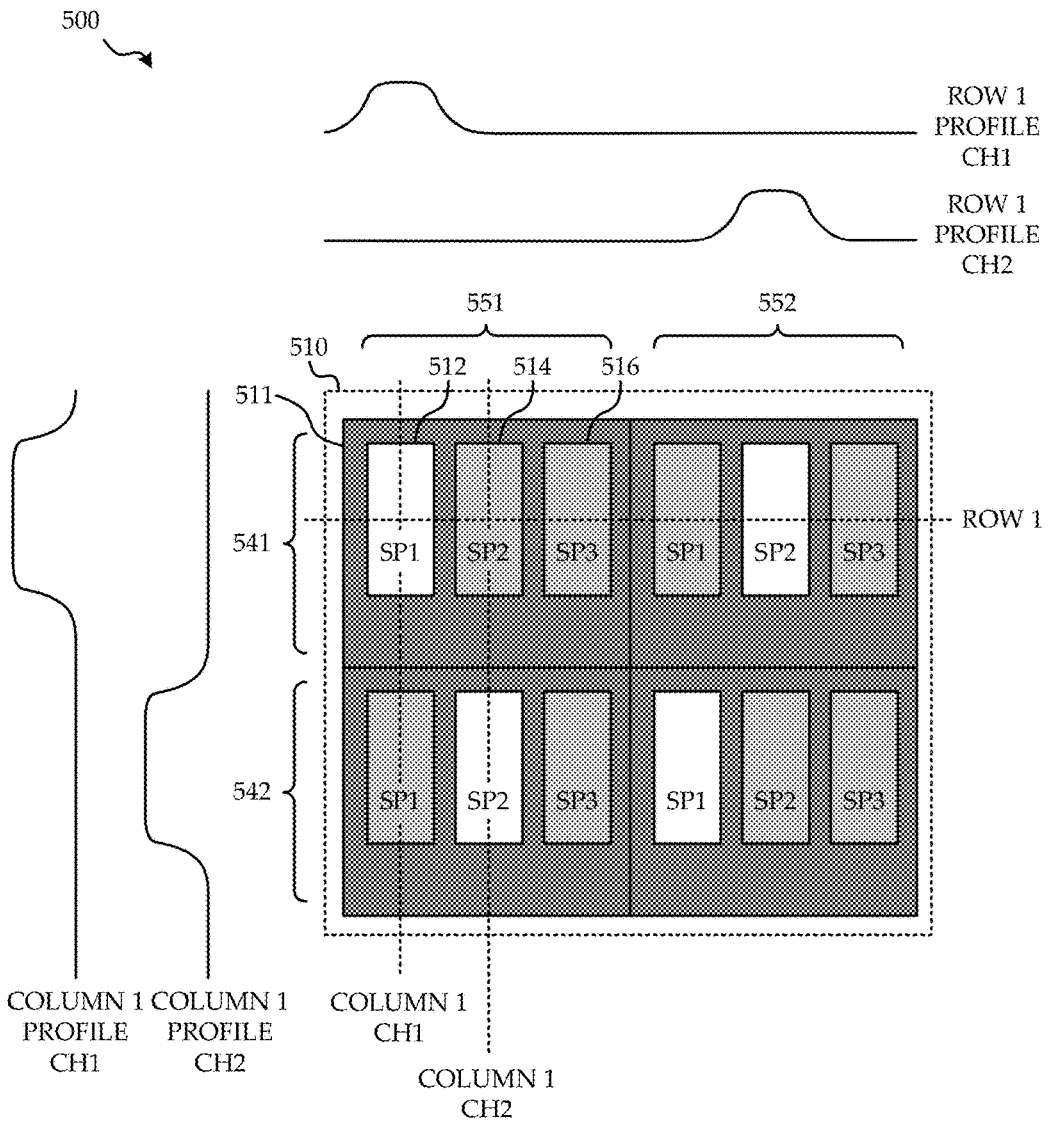
FIG. 5 illustrates pixel identification used in optical feedback according to an embodiment utilizing simultaneous sparse activation of multiple channels.

Referring to FIG. 5, pixel identification 500 used in optical feedback according to an embodiment utilizing simultaneous sparse activation of multiple channels will now be described. In cases where the black areas between adjacent pixels would be insufficient, activation of pixels during each calibration loop is performed with use of a subset of pixels, ensuring some pixels are off to provide the needed extra black spaces. As described above in connection with the embodiment of FIG. 4, calibration time increases when only a subset of pixels is measured at any one time. In order to mitigate this effect, multiple channels are measured (using a multichannel or color optical sensor 240) simultaneously. Sub-pixels of different channels are activated at the same time in sparse patterns. This increases the black area between the sub-pixels for each channel while enabling measurement of multiple types of sub-pixels in parallel.

As with the embodiment of FIG. 4, various sparse pixel activation patterns for each channel may be used including but not limited to a checkerboard pattern of alternatively on and off pixels as depicted in FIG. 5. Generally speaking, considerations for sparse patterns in simultaneous multichannel measurement are the same as considerations for single sparse patterns discussed in association with FIG. 4, but will depend upon the color and resolution capabilities of the optical sensor 230 and the resolution and density of the display panel. It should be understood that the sparse patterns employed by each channel simultaneously need not be the same and may be different from one another.

FIG. 5 depicts pixels 511 (only four shown) of a display panel 510, arranged in rows 541, 542, and columns 551, 552, each pixel of which includes a first subpixel SP1 512, a second subpixel SP2 514, and a third subpixel SP3 516, each corresponding to a channel or color. Subpixels which are active are drawn in white, while subpixels which are inactive or displaying a "black" value are shown in grey. Four luminance profiles are shown for purposes of illustration. "Row 1 Profile CH1" depicts luminance data for channel 1 (corresponding to the first subpixel SP1) along the line passing through Row 1 and all of the subpixels therein, which data reveals only one active subpixel of channel 1 (SP1) along that portion of row 1 followed by a black space. "Row 1 Profile CH2" depicts luminance data for channel 2 (corresponding to the first subpixel SP2) along the line passing through Row 1 and all of the subpixels therein, which data reveals only one active subpixel of channel 2 (corresponding to the second subpixel SP2) along that portion of row 1 preceded by a black space. "Column 1 Profile CH1" depicts luminance data for channel 1 (corresponding to SP1) along the line passing through Column 1, but only though the first subpixel SP1 of each pixel of the column, which data reveals only one active subpixel of channel 1 (SP1) along that portion of column 1 followed by a black space. "Column 1 Profile CH2" depicts luminance data for channel 2 (corresponding to SP2) along the line passing through Column 1, but only though the second subpixel SP2 of each pixel of the column, which data reveals only one active subpixel of channel 2 (SP2) along that portion of column 1 preceded by a black space. As opposed to the case for the embodiment depicted in FIG. 3, channels 1 and 2 and their corresponding subpixels are measured simultaneously, as can be seen by activation only of both first subpixels SP1 and second subpixels SP2 of the pixels of the display.

It should be understood that as part of the process of pixel identification of the embodiments described above, pixel positions for one sample (which can be a reference sample) can be identified and saved using a method as described above and then those positions may be used as a pixilation template for measuring other pixels or new samples. In this case, one may use an alignment step prior to taking the luminance measurement image. Here, showing some pattern in the panel along with the pictures can be used to align a stage upon which the optical sensor is mounted.

Figure 6:
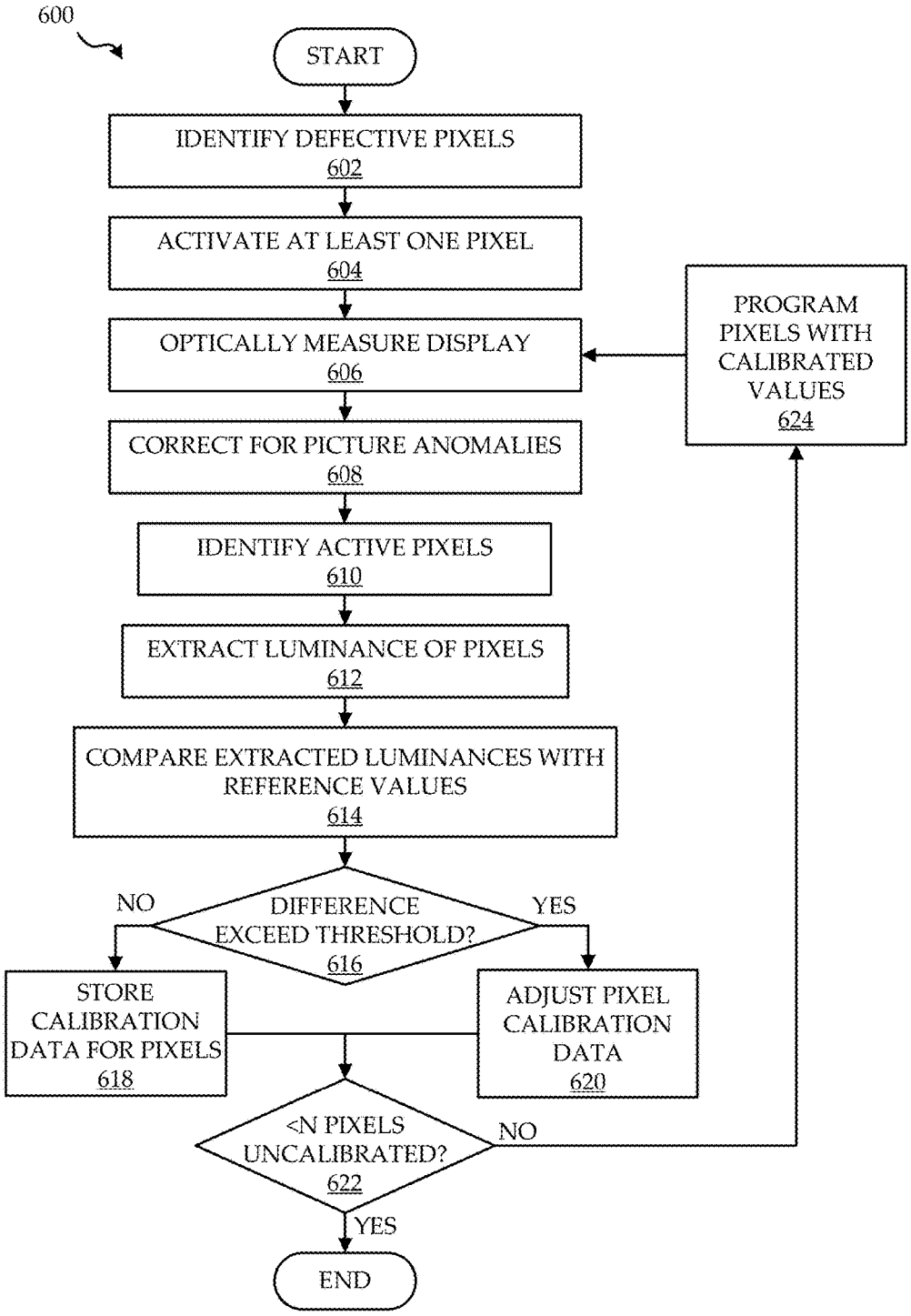
FIG. 6 illustrates a fine optical feedback data calibration method employed by the optical feedback system according to one embodiment.

Referring to FIG. 6, a fine optical feedback data calibration method 600 employed by the optical feedback system according to one embodiment will now be described.

Dead or defective pixels are identified first 602. As described in connection with FIG. 2B, relatively few measurements are performed to identify the pixels that do not respond to changes in calibration data. While the output of working pixels change appropriately in response to changes in the calibration data used to program them, the output of defective pixels do not change enough or change too much in response to changing calibration data. Thus, if in response to being programmed with different calibration data, a pixel's output does not change, changes by an amount below a threshold minimum, or changes by an amount greater than a threshold maximum, the pixel is considered defective. Then at least one pixel is activated 604, i.e. programmed with a value that is higher than black level. A picture or scan is made of the display 606 using the optical sensor, generating a luminance measurement image. As described above, the optical sensor and/or imager is calibrated prior to this step. The luminance measurement image is corrected for anomalies 608 such as the sensor calibration curve using, for example, the sensor calibration data generated during calibration of the optical sensor. This process is well known and can be performed with different methods. In one case, the output of the image sensor is remapped based on its calibration curves to reduce the error caused by non-linearity of the sensor. After anomaly correction, one or more of the methods of pixel identification mentioned above (or a different method) is used to identify the pixels (sub-pixels) 610. From the luminance measurement image and the luminance profiles, the luminance value of each pixel is extracted 612. These luminance values are compared with appropriate reference values 614. The reference value for a subpixel is determined based upon the level at which it is driven and may vary depending upon the type of subpixel, i.e., its particular channel or color, since the luminance produced by different types of subpixel vary and the luminance measurements produced by the optical sensor in each channel may vary. For each pixel, it is determined whether the luminance value is close enough to the reference value with use of a threshold. If the difference does not exceed the threshold 616, the luminance value is deemed close enough and the pixel calibrated, and the calibration data which was used to drive the pixel is stored as final calibration data 618. For each pixel which has a difference in luminance from the reference value which does exceed the threshold 616, calibration is deemed incomplete, and the calibration data is adjusted 620 for each pixel based on the measured data in a manner predicted to compensate for the difference, for retesting during another iteration of the calibration loop. The calibration data is based on the measured pixel luminance value and the previous pixel programming value.

If the number of the pixels deemed as remaining uncalibrated due to their difference in luminance from the reference values still exceeding the threshold, is less than a predefined threshold number of pixels N 622, the process stops. In some embodiments the defective pixels are not counted as uncalibrated and are ignored in this evaluation, and N is set to ensure the process continues until most of the pixels of the display panel are close to the reference value. If the number of the pixels deemed as remaining uncalibrated due to their difference in luminance from the reference values still exceeding the threshold, is not less than N 622, the process continues and each pixel is programmed using the calibration data 624. The feedback loop then continues with a further iteration starting with optical measurement of the display 606. If sparse activation of pixels is used, periodically a different set of pixels will be activated prior to optically measuring the display 606.

Figure 7:
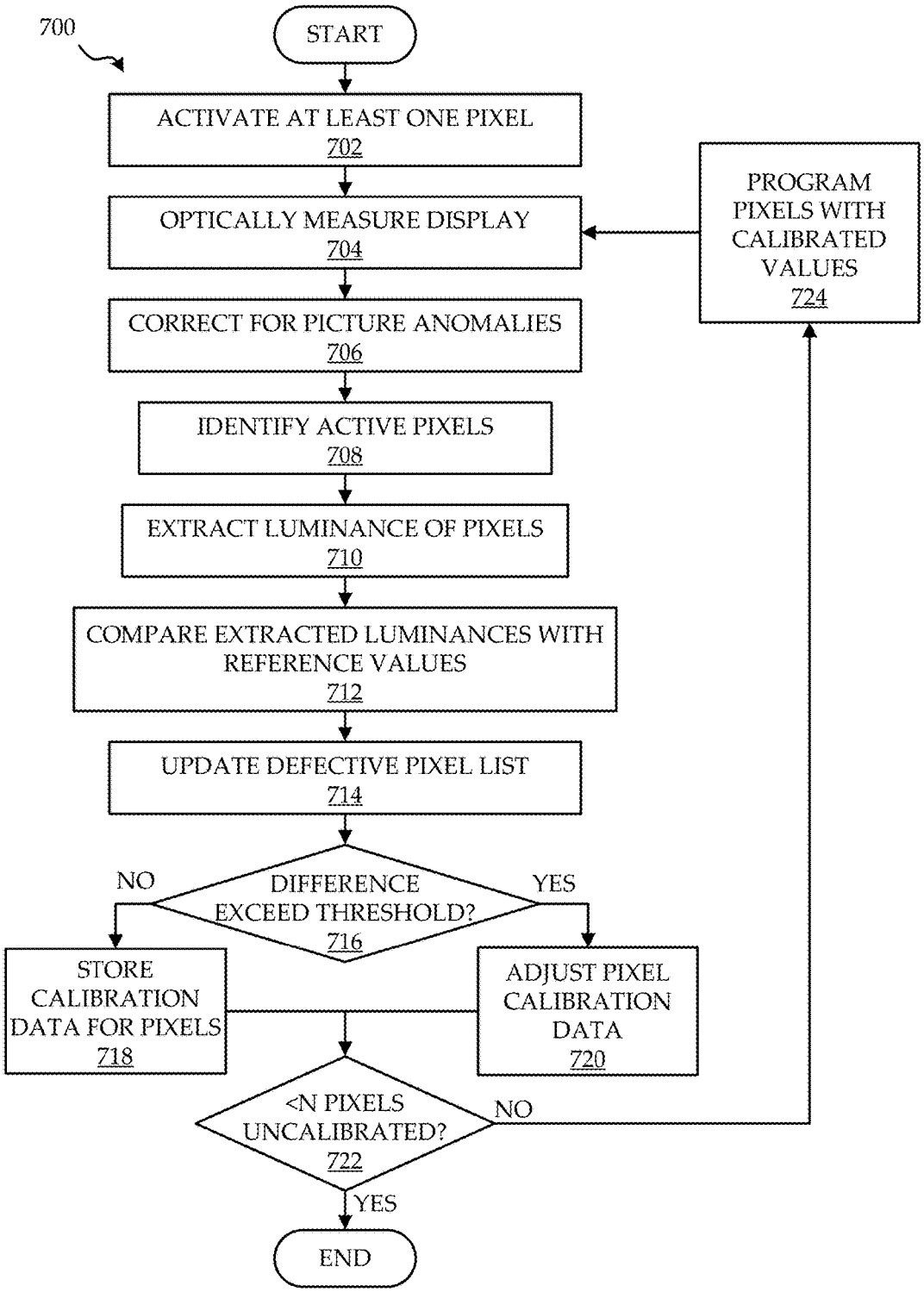
FIG. 7 illustrates a fine optical feedback data calibration method employed by the optical feedback system according to a second embodiment.

Referring to FIG. 7, a second fine optical feedback data calibration method 700 employed by the optical feedback system according to an embodiment will now be described.

For this method, dead pixels are identified within the feedback loop as described below. The method starts with activation of at least one pixel 702, i.e., the pixels are programmed with values higher than black level. A picture or scan is made of the display 704 using the optical sensor, generating a luminance measurement image. As described above, the optical sensor or array is calibrated prior to this step. The luminance measurement image is corrected for anomalies 706 such as the sensor calibration curve as discussed above. After anomaly correction, one or more of the methods of pixel identification mentioned above (or a different method) is used to identify the pixels (sub-pixels) 708. From the luminance measurement image and the luminance profiles, the luminance value of each pixel is extracted 710. These luminance values are compared with appropriate reference values 712 for each pixel. The reference value for a subpixel is determined based upon the level at which it is driven and may vary depending upon the type of subpixel, i.e. its particular channel or color, since the luminance produced by different types of subpixel vary and the luminance measurements produced by the optical sensor in each channel may vary. The response to the programming voltage in the feedback loop is used to identify the defective pixels and the defective pixel list is updated 714. As described in connection with FIG. 2B, pixels are deemed defective when they do not respond to changing calibration data which means they are not responding to changes in programming voltage.

For each pixel which is not defective, it is determined whether the luminance value is close enough to the reference value with use of a threshold. If the difference does not exceed a threshold 716, the luminance value is deemed close enough and the pixel calibrated, and the calibration data which was used to drive the pixel is stored as final calibration data 718. For each pixel which has a difference in luminance from the reference value which does exceed the threshold 716, calibration is deemed incomplete, and the calibration data is adjusted 720 for each pixel based on the measured data in a manner predicted to compensate for the difference, for retesting during another iteration of the calibration loop. The calibration data is based on the measured pixel luminance value and the previous pixel programming value.

If the number of the pixels deemed as remaining uncalibrated due to their difference in luminance from the reference values still exceeding the threshold, is less than a predefined threshold number of pixels N 722, the process stops. The defective pixels of the defective pixel list are ignored in this evaluation. If the number of the pixels deemed as remaining uncalibrated due to their difference in luminance from the reference values still exceeding the threshold, is not less than N 722, the process continues and each pixel is programmed using the calibration data 724. The feedback loop then continues with a further iteration starting with optical measurement of the display 704. If sparse activation of pixels is used, periodically a different set of pixels will be activated prior to optically measuring the display 704.

Although the embodiments of FIG. 6 and FIG. 7 each illustrate a specific method of identifying defective pixels it should be understood that a combination of these techniques may be utilized. Moreover, with respect to the embodiment illustrated in FIG. 7, it should be understood that identifying the defective pixels and updating the defective pixel list 714 may be carried out in different places in the feedback loop.

Figure 8:
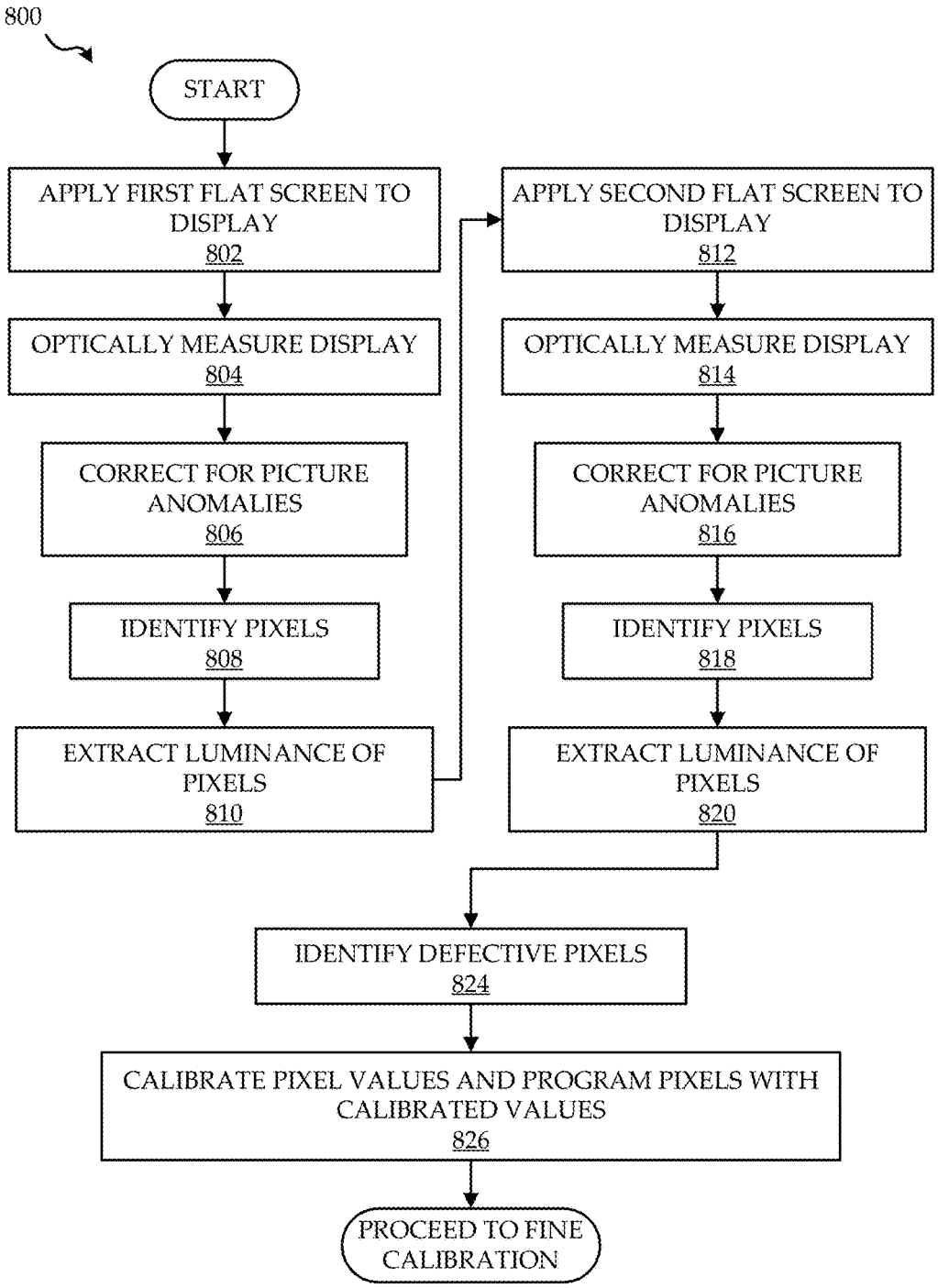
FIG. 8 illustrates a coarse optical feedback data calibration method employed by the optical feedback system according to a further embodiment.

Referring to FIG. 8, a coarse optical feedback data calibration method 800 employed by the optical feedback system according to a further embodiment will now be discussed.

The embodiment of FIG. 8, is a method to accelerate the calibration of the pixel programming value by employing a coarse calibration 800 prior to a fine calibration such as those of the embodiments described in association with FIG. 6 and FIG. 7 or another method of fine calibration.

During coarse calibration 800, two (or more) pictures of the pixels programmed with different values during each picture are taken 802, 812. From the pictures i.e., the luminance measurement images, a coarse input-output characteristic having as many points as measurements per pixel (number of pictures) taken, is extracted for each pixel. Then, a programming value for the intended pixels for calibration is calculated based on the in-out characteristic and a given reference output value 826. As a last step prior to completion of coarse calibration 800, the display panel is initialized i.e., programmed 826 with this calibration data prior to commencement of the fine calibration methods of FIG. 6 or FIG. 7.

In an example embodiment utilizing two programming values, coarse calibration 800 commences with applying a flat screen to the display i.e. applying one luminance value to all the pixels of the display 802. In a similar manner to that described above the display panel displaying the first flat screen is optically measured 804, the luminance measurement image is corrected for anomalies 806, pixels are identified 808, and luminance values for the pixels are extracted. After all luminance values corresponding to the display of the first flat screen are extracted, a second flat screen is applied to the display, i.e. a different luminance value is applied to all the pixels of the display 812. Again, in a similar manner to that described above the display panel displaying the second flat screen is optically measured 814, the luminance measurement image is corrected for anomalies 816, pixels are identified 818, and luminance values for the pixels are extracted. After all luminance values corresponding to the display of the second flat screen are extracted, defective pixels are identified 824 as those pixels which were unresponsive to changes in the programming voltages i.e. unresponsive to the change from being driven by the first and then by the second flat screen luminance value. From the two luminance measurements for each pixel, a coarse input-output characteristic having two data points is extracted for each pixel and a programming value for the intended pixels for calibration is calculated based on the in-out characteristic and a given reference output value 826. In the last step prior to completion of coarse calibration 800, the display panel is initialized i.e., programmed 826 with this calibration data prior to commencement of the fine calibration methods of FIG. 6 or FIG. 7 or another method of fine calibration.

The coarse curve determined from the coarse calibration method 800 may also be utilized in the fine calibration methods of the embodiments described in association with FIG. 6 and FIG. 7 to find the amount of or the direction of the fine tuning in the feedback loop during adjustment of the pixel calibration data 620, 720. Having a coarse measurement of the actual input-output curve addresses the significant different propagation error which otherwise could occur for a display having high non-uniformity. Coarse calibration 800 can also be used to identify the defective pixels prior to the fine calibration methods of the embodiments described in association with FIG. 6 and FIG. 7, and may be used to replace or supplement the defective pixel detection 602, 714 of those embodiments.

It should be understood that in some embodiments the different methods described hereinabove may be combined to optimize the speed and performance of the calibration. In other embodiments achieving the same overall calibration process, the order of the specific steps of the calibration processes above are rearranged. Other embodiments which are combinations of any of the aforementioned embodiments are contemplated and the embodiments described herein are generally applicable to pixels having any subpixel combination and arrangement e.g. RGBW, RGBG, etc.

While particular implementations and applications of the present disclosure have been illustrated and described, it is to be understood that the present disclosure is not limited to the precise construction and compositions disclosed herein and that various modifications, changes, and variations can be apparent from the foregoing descriptions without departing from the spirit and scope of an invention as defined in the appended claims.

What is claimed is:

1. An optical feedback method for calibrating an emissive display system having pixels, each pixel having a light-emitting device, the method comprising:

iteratively performing a calibration loop until a number of pixels of the display determined to be uncalibrated is less than a threshold number of pixels, the calibration loop comprising:

measuring the luminance of pixels of the display generating luminance measurements for each pixel;

comparing luminance measurements for the pixels with reference values generating a difference value for each pixel measured;

determining for each pixel whether the difference value exceeds a difference threshold, and for pixels having a difference value which does not exceed the difference threshold determining the pixel to be calibrated and storing currently used calibration data for the pixel as final calibration data for the pixel, and for pixels having a difference value which exceeds the difference threshold determining the pixel to be uncalibrated and adjusting the calibration data for the pixel with use of the luminance measurement for the pixel and previous calibration data for the pixel;

programming each pixel whose calibration data was adjusted with the adjusted calibration data.

2. The method of claim 1 wherein measuring the luminance of pixels of the display comprises identifying the pixels of the display comprising:

activating at least one pixel of the display for luminance measurement;

generating a luminance measurement image of the pixels of the display after activating the at least one pixel;

identifying pixels of the display from the variation in luminance in the luminance measurement image; and extracting luminance data for each pixel identified at a position within the luminance measurement image with use of the luminance data along at least one luminance profile passing through the position within the luminance measurement image to generate said luminance measurement for said pixel.

3. The method of claim 2 wherein activating the at least one pixel of the display comprises activating a sparse pixel pattern wherein between any two pixels activated for luminance measurement there is at least on pixel which is inactive, thereby providing luminance measurement data corresponding to a black area between the two pixels along the at least one luminance profile.

4. The method of claim 2 wherein activating the number of pixels of the display comprises activating a multichannel sparse pixel pattern wherein more than one channel of pixels is activated simultaneously and between any two pixels activated of any channel for luminance measurement there is at least on pixel of that channel which is inactive, thereby providing a luminance measurement data corresponding to a black area of that channel between the two pixels along the at least one luminance profile.

5. The method of claim 2, further comprising:

identifying defective pixels unresponsive to changes in calibration data for the defective pixels;

correcting the luminance measurement image after generated for anomalies; and calibrating an optical sensor used for measuring the luminance of pixels of the display prior to measuring the luminance of pixels of the display.

6. The method of claim 3, further comprising:

identifying defective pixels unresponsive to changes in calibration data for the defective pixels;

correcting the luminance measurement image after generated for anomalies; and calibrating an optical sensor used for measuring the luminance of pixels of the display prior to measuring the luminance of pixels of the display.

7. The method of claim 4, further comprising:

identifying defective pixels unresponsive to changes in calibration data for the defective pixels;

correcting the luminance measurement image after generated for anomalies; and calibrating an optical sensor used for measuring the luminance of pixels of the display prior to measuring the luminance of pixels of the display.

8. The method of claim 1 further comprising:

prior to iteratively performing the calibration loop:

programming each of the pixels of the display with at least two unique values;

measuring the luminance of the pixels corresponding to each programmed unique value, generating coarse input-output characteristics for each pixel;

generating calibration data for each pixel based on the coarse input-output characteristics for each pixel; and programming each of the pixels of the display with the calibration data for the pixel.

9. The method of claim 3 further comprising:

prior to iteratively performing the calibration loop:

programming each of the pixels of the display with at least two unique values;

measuring the luminance of the pixels corresponding to each programmed unique value, generating coarse input-output characteristics for each pixel;

generating calibration data for each pixel based on the coarse input-output characteristics for each pixel; and programming each of the pixels of the display with the calibration data for the pixel.

10. The method of claim 9 further comprising:

identifying defective pixels unresponsive to changes in calibration data for the defective pixels;

correcting the luminance measurement image after generated for anomalies; and calibrating an optical sensor used for measuring the luminance of pixels of the display prior to measuring the luminance of pixels of the display.

11. An optical feedback system for calibrating an emissive display system having pixels, each pixel having a light-emitting device, the system comprising:

a display panel comprising said pixels;

an optical sensor operative to measure luminance of pixels of the display panel;

optical feedback processing coupled to the optical sensor; and a controller of the emissive display system coupled to said optical feedback processing and for iteratively controlling a calibration loop until a number of pixels of the display panel determined to be uncalibrated is less than a threshold number of pixels, iteratively controlling the calibration loop comprising:

controlling the optical sensor and the optical feedback processing to measure the luminance of pixels of the display panel generating luminance measurements for each pixel;

controlling the optical feedback processing to compare luminance measurements for the pixels with reference values generating a difference value for each pixel measured;

controlling the optical feedback processing to determine for each pixel whether the difference value exceeds a difference threshold, and for pixels having a difference value which does not exceed the difference threshold to determine the pixel to be calibrated and store currently used calibration data for the pixel as final calibration data for the pixel, and for pixels having a difference value which exceeds the difference threshold to determine the pixel to be uncalibrated and adjust the calibration data for the pixel with use of the luminance measurement for the pixel and previous calibration data for the pixel; and programming each pixel whose calibration data was adjusted with the adjusted calibration data.

12. The system of claim 11 wherein the controller's controlling of the optical sensor and the optical feedback processing to measure the luminance of pixels of the display panel comprises controlling identification of the pixels of the display panel comprising:

activating at least one pixel of the display panel for luminance measurement;

controlling the optical sensor and optical feedback processing to generate a luminance measurement image of the pixels of the display panel after activating the at least one pixel;

controlling the optical feedback processing to identify pixels of the display panel from the variation in luminance in the luminance measurement image; and controlling the optical feedback processing to extract luminance data for each pixel identified at a position within the luminance measurement image with use of the luminance data along at least one luminance profile passing through the position within the luminance measurement image to generate said luminance measurement for said pixel.

13. The system of claim 12 wherein the controller's activating the at least one pixel of the display comprises activating a sparse pixel pattern wherein between any two pixels activated for luminance measurement there is at least on pixel which is inactive, thereby providing luminance measurement data corresponding to a black area between the two pixels along the at least one luminance profile.

14. The system of claim 12 wherein the controller's activating the number of pixels of the display comprises activating a multichannel sparse pixel pattern wherein more than one channel of pixels is activated simultaneously and between any two pixels activated of any channel for luminance measurement there is at least on pixel of that channel which is inactive, thereby providing a luminance measurement data corresponding to a black area of that channel between the two pixels along the at least one luminance profile.

15. The system of claim 12, wherein the optical sensor is calibrated prior being used for measuring the luminance of pixels of the display, and wherein the controller is further for:

controlling the optical feedback processing to identify defective pixels unresponsive to changes in calibration data for the defective pixels; and controlling the optical feedback processing to correct the luminance measurement image after generated for anomalies.

16. The system of claim 13, wherein the optical sensor is calibrated prior being used for measuring the luminance of pixels of the display, and wherein the controller is further for:

controlling the optical feedback processing to identify defective pixels unresponsive to changes in calibration data for the defective pixels; and controlling the optical feedback processing to correct the luminance measurement image after generated for anomalies.

17. The system of claim 14, wherein the optical sensor is calibrated prior being used for measuring the luminance of pixels of the display, and wherein the controller is further for:

controlling the optical feedback processing to identify defective pixels unresponsive to changes in calibration data for the defective pixels; and controlling the optical feedback processing to correct for anomalies the luminance measurement image after generated.

18. The system of claim 11, wherein the controller is further for prior to iteratively performing the calibration loop:

programming each of the pixels of the display with at least two unique values;

controlling the optical sensor and the optical feedback processing to measure the luminance of the pixels corresponding to each programmed unique value, to generate coarse input-output characteristics for each pixel;

generating calibration data for each pixel based on the coarse input-output characteristics for each pixel; and programming each of the pixels of the display with the calibration data for the pixel.

19. The system of claim 13, wherein the controller is further for prior to iteratively performing the calibration loop:

programming each of the pixels of the display with at least two unique values;

controlling the optical sensor and the optical feedback processing to measure the luminance of the pixels corresponding to each programmed unique value, to generate coarse input-output characteristics for each pixel;

generating calibration data for each pixel based on the coarse input-output characteristics for each pixel; and programming each of the pixels of the display with the calibration data for the pixel.

20. The system of claim 19, wherein the optical sensor is calibrated prior being used for measuring the luminance of pixels of the display, and wherein the controller is further for:

controlling the optical feedback processing to identify defective pixels unresponsive to changes in calibration data for the defective pixels; and controlling the optical feedback processing to correct for anomalies the luminance measurement image after generated.

* * * * *